US012687307B2

(12) United States Patent
Jeon et al.

(10) Patent No.: US 12,687,307 B2
(45) Date of Patent: Jul. 21, 2026

(54) AIR CONDITIONER INCLUDING CONTROL BOX

(71) Applicant: SAMSUNG ELECTRONICS CO., LTD., Suwon-si (KR)

(72) Inventors: Mingu Jeon, Suwon-si (KR); Donghyun Kim, Suwon-si (KR); Hyunho Kim, Suwon-si (KR); Byungyul So, Suwon-si (KR); Joonho Yoon, Suwon-si (KR); Buyoun Lee, Suwon-si (KR); Jinwoo Hong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 363 days.

(21) Appl. No.: 18/368,781

(22) Filed: Sep. 15, 2023

(65) Prior Publication Data

US 2024/0191883 A1 Jun. 13, 2024

Related U.S. Application Data

(63) Continuation of application No. PCT/KR2023/013162, filed on Sep. 4, 2023.

(30) Foreign Application Priority Data

Dec. 12, 2022 (KR) ..... 10-2022-0172800

(51) Int. Cl.
*F24F 1/0047* (2019.01)

(52) U.S. Cl.
CPC ..... *F24F 1/0047* (2019.02)

(58) Field of Classification Search
CPC ..... F24F 1/0057; F24F 1/0068; F24F 11/88; F24F 11/89; F24F 13/20
See application file for complete search history.

(56) References Cited

U.S. PATENT DOCUMENTS 8,272,229 B2 9/2012 Choi et al.
9,746,231 B2 8/2017 Moon et al.
(Continued)

FOREIGN PATENT DOCUMENTS

CN 104168747 B 11/2014
CN 206430316 U * 8/2017
(Continued)

OTHER PUBLICATIONS

International Search Report, PCT/ISA/210, dated Dec. 1, 2023, issued in PCT Application No. PCT/KR2023/013162.
(Continued)

*Primary Examiner* — Allen R. B. Schult
(74) *Attorney, Agent, or Firm* — STAAS & HALSEY LLP

(57) ABSTRACT

An air conditioner that is installable in a ceiling, the air conditioner including a housing having an intake port; a piping connection including a pipe connected from an inside of the housing to an outside of the housing; a blower fan inside the housing; and a control box configured to control driving of the blower fan, wherein the control box is connected to the housing so as to be movable, when the air conditioner is installed in the ceiling, between a first position in which the control box overlaps the piping connection vertically, and a second position in which the control box overlaps less of the piping connection than when the control box is in the first position.

15 Claims, 18 Drawing Sheets

(56) References Cited

U.S. PATENT DOCUMENTS

| | | | | |
|---|---|---|---|---|
| 10,724,760 | B2 | 7/2020 | Iwatsuki et al. | |
| 11,131,479 | B2 * | 9/2021 | Miyata ..... | F24F 13/20 |
| 2021/0055008 | A1 | 2/2021 | Kim et al. | |

FOREIGN PATENT DOCUMENTS

| | | | |
|---|---|---|---|
| JP | 7-145955 | A | 6/1995 |
| JP | 7- 239134 | A | 9/1995 |
| JP | 2902857 | | 6/1999 |
| JP | 3622647 | | 2/2005 |
| JP | 2010-121859 | | 6/2010 |
| JP | 2012-215305 | | 11/2012 |
| JP | 6257335 | | 1/2018 |
| JP | 6576470 | | 9/2019 |
| KR | 20-0351853 | | 5/2004 |
| KR | 10-2006-0007612 | | 1/2006 |
| KR | 10-2006-0015974 | | 2/2006 |
| KR | 10-1354214 | | 1/2014 |
| KR | 10-2019-0107362 | | 9/2019 |
| KR | 10-2168584 | | 10/2020 |
| KR | 10-2396939 | | 5/2022 |
| WO | WO 2008/136379 | A1 | 11/2008 |
| WO | WO 2013/129527 | A1 | 9/2013 |

OTHER PUBLICATIONS

Written Opinion, PCT/ISA/237, dated Dec. 1, 2023, issued in PCT Application No. PCT/KR2023/013162.
Extended European Search Report dated Nov. 21, 2025 issued in counterpart European Patent Application No. 23903678.3.

* cited by examiner

AIR CONDITIONER INCLUDING CONTROL BOX

CROSS-REFERENCE TO RELATED APPLICATION

This application is a continuation application, under 35 U.S.C. § 111(a), of International Application No. PCT/KR2023/013162 designating the United States, filed on Sep. 4, 2023, in the Korean Intellectual Property Receiving Office, which claims priority from Korean Patent Application No. 10-2022-0172800, filed on Dec. 12, 2022, in the Korean Intellectual Property Office, the disclosures of which are incorporated by reference herein in their entireties.

BACKGROUND

1. Field

Embodiments of the disclosure relate to an indoor unit of an air conditioner including a control box having a moving structure.

2. Description of Related Art

An air conditioner may be a device for maintaining a certain air quality in a specified space (hereinafter, referred to as an "indoor space") in a condition suitable for its purpose and use. For example, when operating in a cooling mode, the air conditioner may cool the indoor space by sucking out or removing hot air from the indoor space, exchanging heat with a low-temperature refrigerant, and then discharging the cooled air into the indoor space. For example, when operating in a heating mode, the air conditioner may heat the indoor space by sucking our or removing cold air from the indoor space, exchanging heat with a high-temperature refrigerant, and then discharging the heated air into the indoor space.

In general, air conditioners may be categorized into an integrated-type and a split-type depending on whether the indoor and outdoor units are combined or separated/detached from each other. The integral-type air conditioner consists of an indoor unit and an outdoor unit combined into a single unit, while the split-type air conditioner includes an indoor unit installed in an indoor space and an outdoor unit installed in an outdoor space, with the outdoor unit being connected to the indoor unit by refrigerant piping.

In the case of a ceiling-type air conditioner, which is considered a split-type, the indoor unit may be installed and fixed to a ceiling. In such a ceiling type of air conditioner, due to limited indoor space, a control box, which is configured to control the operation of the indoor unit, is typically arranged in or near an air flow path adjacent or close to an air intake port. In such a circumstance, during operation of the air conditioner, the control box may disrupt and/or interfere with air flow flowing into the air intake port, thereby deteriorating the performance of the air conditioner.

SUMMARY

Various embodiments of the disclosure may provide an air conditioner having a control box disposed out of a housing and having a movable rotating structure.

According to an embodiment of the disclosure, an air conditioner that is installable in a ceiling includes a housing having an intake port; a piping connection including one or more pipes connected from an inside of the housing to an outside of the housing; a blower fan inside the housing; and a control box configured to control driving of the blower fan, wherein the control box is connected to the housing so as to be movable, when the air conditioner is installed in the ceiling, between a first position in which the control box overlaps the piping connection vertically, and a second position in which the control box overlaps less of the piping connection than when the control box is in the first position.

According to an embodiment of the disclosure, the control box may be closer to the intake port in the second position than in the first position.

According to an embodiment of the disclosure, the air conditioner may further include a link assembly may include a first connector defining a first rotation axis and connected to the housing. The control box may be movable between the first position and the second position by rotation of the link assembly about the first rotation axis.

According to an embodiment of the disclosure, the link assembly may include a second connector defining a second rotation axis parallel to the first rotation axis and connected to the control box. The control box may be rotatable about the second rotation axis.

According to an embodiment of the disclosure, the housing may include a first interlocking hole. The control box may include a second interlocking hole. The first connector of the link assembly may include an annular first protrusion inserted into the first interlocking hole in the housing. The second connector of the link assembly may include an annular second protrusion inserted into the second interlocking hole in the control box.

According to an embodiment of the disclosure, the annular first protrusion and the annular second protrusion may each be configured to have a tapered shape with a diameter that gradually decreases toward an outside of the link assembly.

According to an embodiment of the disclosure, the link assembly may include a first link structure and a second link structure. The first link structure may connect a first side of the control box to a first side of the housing. The second link structure may connect a second side of the control box to a second side of the housing.

According to an embodiment of the disclosure, the link assembly may include a link body integrally connecting the first connector and the second connector.

According to an embodiment of the disclosure, the air conditioner may further include an electric wire electrically connecting the blower fan and the control box. The link assembly may include a link body having a wire receiving space formed to receive the electric wire.

According to an embodiment of the disclosure, the link assembly may include a link cover detachably coupled to the link body to cover the wire receiving space.

According to an embodiment of the disclosure, a coupling groove may be formed in the link body. The link cover may include a coupling protrusion that is insertable into the coupling groove to attach the link cover to the link body.

According to an embodiment of the disclosure, the air conditioner may further include an electric wire electrically connecting the blower fan and the control box. The link assembly may include a link body having a wire receiving space formed to receive the electric wire. The first connector may include a first wire hole communicating with the wire receiving space. The second connector may include a second wire hole communicating with the wire receiving space. The first wire hole may open into the link body in a direction parallel to the first rotation axis. The second wire hole may be spaced apart from the first wire hole in a horizontal direction and opens into the link body in a direction parallel to the second rotation axis. The electric wire may pass through the first wire hole, the wire receiving space, and the second wire hole.

According to an embodiment of the disclosure, the link body may include a first slit formed on a first end of the link body so as to extend along an axial direction of the first rotation axis, and a second slit formed on a second end of the link body so as to extend along an axial direction of the second rotation axis.

According to an embodiment of the disclosure, the air conditioner may further include a stopper protruding from one side surface of the housing to fix the control box in the first position.

According to an embodiment of the disclosure, the stopper may be adjacent to a lower end of the one side surface of the housing.

According to various embodiments of the disclosure, the control box of the indoor unit may be disposed at an outer position that does not interfere with air flow through the intake port, thereby improving the performance of the indoor unit.

According to various embodiments of the disclosure, when it is necessary for installation or maintenance of a refrigerant pipe and so on, the control box of the indoor unit may appropriately change its position so as not to interfere with its installation or maintenance.

When it is required, for example, an installation or maintenance of a refrigerant piping, a drain pipe, or the like, the control box may be rotated by means of a link assembly to a position that does not interrupt the piping or pipes, thereby improving the workability of a user (or a service person) of an air conditioner. Further, when the user has completed the installation or maintenance of the refrigerant piping, the drain pipe, or the like, the user may cause the control box to be rotated back to its original position, for example, a position adjacent to the piping or the pipe and not to cover the intake port, with the link assembly, thereby facilitating air flow toward the intake port during operation of the air conditioner.

The effects that can be obtained from the exemplary embodiments of the present disclosure may be clearly derived and understood by those having ordinary knowledge in the technical field to which the embodiments of the disclosure belongs, from the following description. That is to say, any unintended effects according to carrying out the exemplary embodiments of the disclosure may be also clearly derived by those having ordinary knowledge in the art, from the exemplary embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

With regard to description of the drawings, the same or like reference numerals may be used to refer to the same or like components.

DETAILED DESCRIPTION

Figure 1:
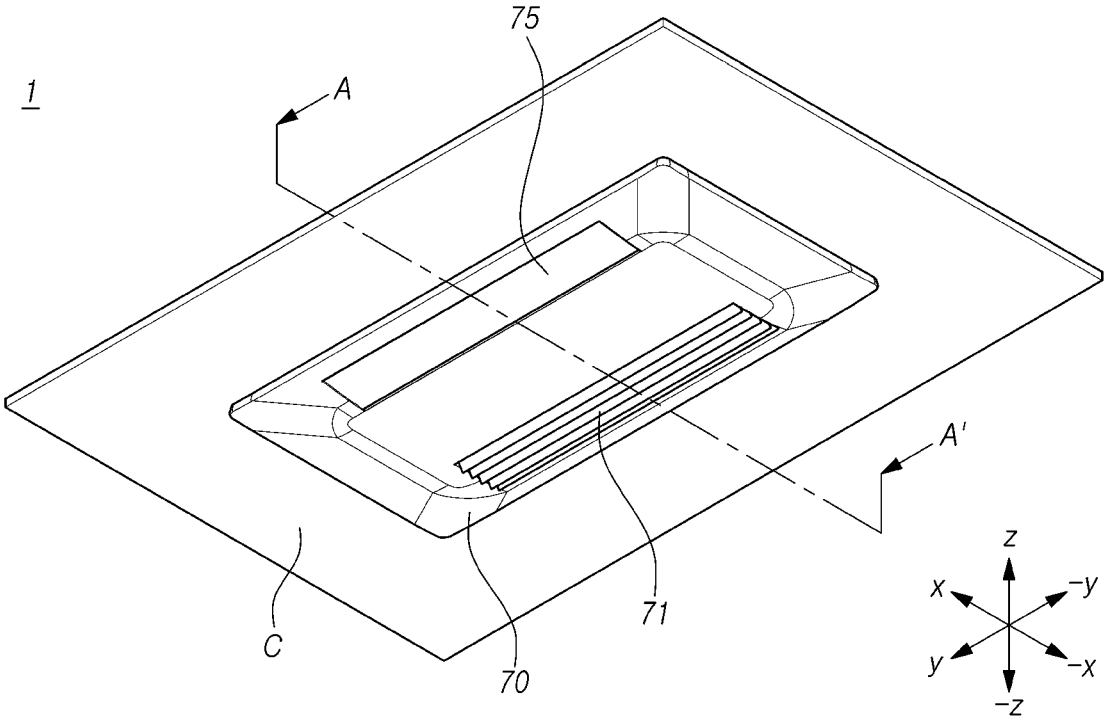
FIG. 1 is a perspective view of an exterior of a ceiling-type air conditioner according to an embodiment of the disclosure, viewed from its bottom side.

As used herein, each of the phrases such as "A or B", "at least one of A and B", "at least one of A or B", "A, B or C", "at least one of A, B and C", and "at least one of A, B, or C" may include any one of the items enumerated together in a corresponding one of the phrases, or all possible combinations thereof. Further, it should be appreciated that the term 'and/or' used herein encompasses any and all possible combinations of one or more of the listed items. The terms such as "the first", "the second", or "first", or "second" may be used simply to distinguish a corresponding component from another component, and do not limit the corresponding components in view of other aspect (e.g., importance or order).

It is to be understood that when an element (e.g., a first element) is referred to, with or without the term "operatively" or "communicatively", as "~ coupled", "~ connected", "~ supported", "~ contacted" or "~ in contact" to/with another element (e.g., a second element), it includes not only when the element is directly coupled, connected, supported, or in contact with the other element, but also when the element is indirectly coupled, connected, supported, or in contact with the other element through a third element.

The terms such as "comprise", "include", "have", and "consist of" used herein are only intended to designate that there are features, numbers, steps, operations, components, parts, or a combination thereof described in the disclosure, and are not intended to exclude in advance a possibility of the presence or addition of one or more other features, numbers, steps, operations, components, parts, or a combination thereof, by using these terms. When a component is referred to as being located "on" another component, it includes not only the case where the component is contact with the other element, but also the case where another component exists between the two elements.

As used in the disclosure, the expression "configured to ~" may be used interchangeably with, depending on the context, for example, "suitable for ~", "having the ability to ~", "designed to ~", "modified to ~", "made to ~", "capable of ~" or the like. The term "configured to ~" may not necessarily mean only "specially designed to ~" in hardware. Instead, in some situations, the expression "a device configured to ~" may mean that the device is "capable of ~" together with another device or component. For example, a phrase "a device configured (or adapted) to perform A, B, and C" may represent a dedicated device for performing a corresponding operation or imply a general-purpose device capable of performing various operations including the corresponding operation.

Meanwhile, the terms such as e.g., "upper", "lower", and "forward/backward direction" used in the disclosure are defined on the basis of the accompanying drawings, and the shapes and positions of the corresponding component are not limited by these terms.

Although the description disclosed herein is focused on specific embodiments, it should be understood that the disclosure is not limited to such specific embodiments, and all changes, modifications, equivalents, and/or substitutes of various embodiments described herein are encompassed. In conjunction with the description of drawings, similar or like reference numerals may be used to refer to similar or related elements.

Hereinafter, various example air conditioners will be described in greater detail with reference to the accompanying drawings.

Figure 2:
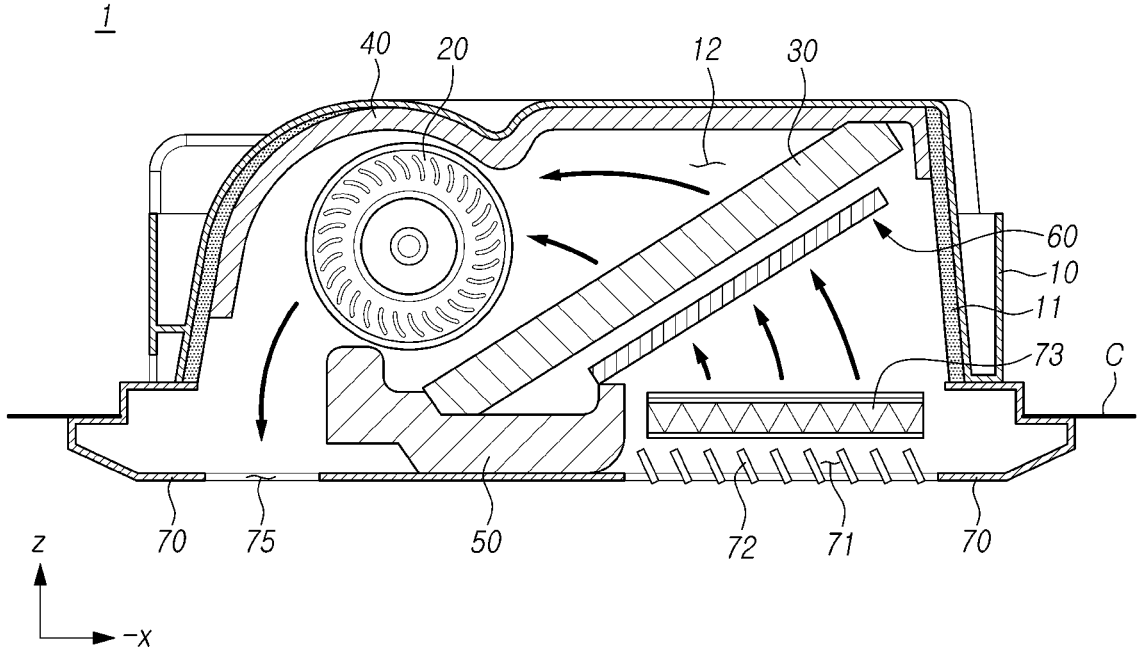
FIG. 2 is a vertical cross-sectional view of the air conditioner of FIG. 1, taken along a line A-A'.

FIG. 1 is a perspective view of an exterior of a ceiling-type air conditioner according to an example, viewed from its bottom side. FIG. 2 is a vertical cross-sectional view of the air conditioner of FIG. 1, taken along a line A-A'.

Referring to FIGS. 1 and 2, in an example, an air conditioner 1 may include a housing 10, a blower fan 20, a heat exchanger 30, a flow path guide 40, a drain 50, a condensate guide 60, and a ceiling panel 70.

According to an example, the housing 10 may be embedded inside a ceiling surface C (an area embedded inside the ceiling surface C is not shown in FIG. 1). In an example, the housing 10 may be hexahedron-shaped with an open lower part, but the present disclosure does not limit a specific shape of the housing thereto.

According to an example, as illustrated in FIG. 2, the housing 10, embedded upwardly along the Z-axis direction toward the inside of the ceiling surface C, may include an empty space therein.

According to an example, the housing 10 may include an insulating member 11 disposed on an inner surface of the wall of the housing 10 to surround an inner empty space of the housing 10. The insulating member 11 may include, for example, foamed polystyrene, but the disclosure is not limited thereto.

According to an example, the inner empty space of the housing 10 may include an air-conditioning space 12 where an air flow is generated to perform air conditioning operation. In this air conditioning space 12 of the air conditioner, components, such as the blower fan 20, the heat exchanger 30, and the condensate guide 60, may be included.

According to an example, the blower fan 20 may be disposed inside the housing 10 (e.g., the air conditioning space 12). The blower fan 20 may be, for example, a cross-flow fan having a rotational axis (not shown) extending along a longitudinal direction (e.g., the Y-axis direction) of the housing 10. The blower fan 20 may be rotated by a motor (not shown) with one end coupled to the rotational axis. In such a case, an air flow may be formed in the air conditioning space 12 due to the rotation of the blower fan 20. The air flow may be formed in a direction from an intake port 71 toward a discharge port 75, which will be described later. More specifically, in case where the air flow is generated by the rotation of the blower fan 20, the air introduced into the housing 10 through the intake port 71 may be heated/cooled with heat-exchange via the heat exchanger 30 and then discharged to the indoor space through the discharge port 75.

According to an example, the heat exchanger 30 may be disposed inside the housing 10 (e.g., the air conditioning space 12). The heat exchanger 30 may be positioned between the intake port 71 and the blower fan 20, which will be described later. The heat exchanger 30 may be slantingly (e.g., angled) disposed in the housing 10. For example, the heat exchanger 30 may have a lower end disposed below the blower fan 20, and it may slantingly extend to be inclined with respect to a ground from the lower end toward the upper space of the intake port 71. In such a case, a lateral space (side area) of the heat exchanger 30 facing the ground or the intake port 71 may increase and thus, increasing the contact area of the air flowing in through the intake port 71 with the heat exchanger 30, thereby improving the heat exchange efficiency in the heat exchanger 30. Such an inclined side portion of the heat exchanger 30 may be extended along the longitudinal direction (e.g., the Y-axis direction) of the housing 10. In an example, the heat exchanger 30 may be configured to have two rows, but the disclosure is not limited thereto. In an example, although not specifically illustrated herein, the heat exchanger 30 may include a main heat exchanger and an auxiliary heat exchanger.

According to an example, the flow path guide 40 may be configured to direct the air to flow from the intake port 71 to the discharge port 75. In an example, the flow path guide 40 may be configured to surround (or cover) the blower fan 20 and the heat exchanger 30 disposed in the air conditioning space 12. In an example, the flow path guide 40 may further extend along the longitudinal direction (e.g., the Y-axis direction) of the housing 10. In an example, the flow path guide 40 may be formed to extend downward from an upper part of the air conditioning space 12 inside the housing 10. In an example, the flow path guide 40 may be provided to have a curved surface, at least partially, to correspond to the shape of the blower fan 20 in a certain region of the air conditioning space 12 adjacent to the blower fan 20. In such a case, the flow path guide 40 may guide the air to flow from the intake port 71 to the discharge port 75 while the blower fan 20 is in operation and may prevent the air to flow in the opposite direction (e.g., backflow) away from the intake port 71.

According to an example, the drain 50 may be configured to receive condensate (or condensed water) formed on a surface of the heat exchanger 30 due to a heat exchange process occurring in the heat exchanger 30. In an example, the drain 50 may be disposed below the heat exchanger 30. In an example, the drain 50 may have a concave groove supporting a lower end of the heat exchanger 30. The condensate guided by a condensate guide 60, to be described later, may be received in the groove of the drain 50. The condensate received in the groove of the drain 50 may be discharged to an outside through a drain hose (e.g., as indicated by a reference numeral 51 of FIG. 4) connected to the outside.

In an example, the condensate guide 60 may be provided at a lower side of the inclined side portion of the heat exchanger 30. In an example, the heat exchanger 30 may be disposed with an incline (e.g., angled) above the intake port 71, in which case the condensate guide 60 may be located upstream of the heat exchanger 30 on an air flow path. For example, the condensate guide 60 may be arranged rearwardly (e.g., in the −X-axis direction) and downwardly (e.g., in the −Z-axis direction) with respect to the heat exchanger 30. According to an example, the condensed water formed on a surface of the heat exchanger 30 by the heat exchange process or condensate may fall toward the ground, and the condensate guide 60 may guide the condensed water falling down to the drain 50. Although it is illustrated in the drawings that the condensate guide 60 is disposed next to the heat exchanger 30 at the same angle with respect to the ground or the ceiling surface, the disclosure is not limited thereto.

According to an example, the ceiling panel 70 may be attached to the ceiling surface C to cover the lower side of the housing 10, that is, the lower side of the air conditioning space 12. According to an example, in addition to the inner space of the housing 10, the ceiling panel 70 may be disposed in the ceiling surface C to cover various separate components that are outside of the housing 10 and are installed within the inner space of the ceiling surface C such as a lowermost part of the piping connection, and the control box. According to an example, the ceiling panel 70 may have a rectangular shape, but the disclosure is not limited thereto.

According to an example, the ceiling panel 70 may include the intake port 71, a suction grill 72, an air filter 73, and the discharge port 75.

According to an example, the intake port 71 may be provided in the ceiling panel 70 to allow air flow from an interior space of a room into the housing 10. In an example, the intake port 71 may be disposed on one side (e.g., in the −X-axis direction) of the ceiling panel 70. In an example, the intake port 71 may be arranged below the heat exchanger 30. In an example, the intake port 71 may be formed to open downwardly from the ceiling panel 70. In an example, the intake port 71 may be formed to be extended in the longitudinal direction (e.g., the Y-axis direction) of the ceiling panel 70.

According to an example, the suction grill 72 may be disposed at the intake port 71. In an example, the suction grill 72 may be provided to prevent foreign substances from entering the housing 10 and to protect the components of the air conditioner 1. In an example, the suction grill 72 may be provided in a lattice structure with a certain interval in width and length, but the disclosure is not limited thereto.

According to an example, the air filter 73 may be disposed inside the housing 10 and positioned above the intake port 71. In an example, the air filter 73 may be provided to filter foreign substances contained in the air of the housing 10 introduced through the intake port 71. The air filter 73 may include, for example, various types of filters such as an electric dust collecting filter, a HEPA filter, an antibacterial filter, and a deodorizing filter, but the disclosure is not limited to the specific type and number of filters. In this connection, the foreign substances contained in the air of the housing 10 entered through the intake port 71 may be primarily filtered out by the suction grill 72 and thereafter, secondarily filtered by the air filter 73.

According to an example, the discharge port 75 may be provided in the ceiling panel 70 to discharge air, which has undergone heat exchange inside the housing 10, into the indoor space. In an example, the discharge port 75 may be disposed on the other side (e.g., +X direction) of the ceiling panel 70, which is positioned opposite to the intake port 71. In an example, the discharge port 75 may be arranged below the blower fan 20. In an example, the discharge port 75 may be formed to be open downwardly of the ceiling panel 70. In an example, the discharge port 75 may be formed to extend in the longitudinal direction (e.g., the Y-axis direction) of the ceiling panel 70.

According to an example, although not specifically illustrated herein, the discharge port 75 may be provided with a louver structure (or vane structure) (not shown) configured to adjust the wind direction of the air discharged via the discharge port 75. For example, the louver structure may be provided to be rotatable in up/down direction within a predetermined range of angle with respect to the ceiling surface C, and the wind direction of the air discharged to the outer indoor space through the discharge port 75 may be adjusted in the up-down direction by means of rotation of the louver structure.

Figure 3:
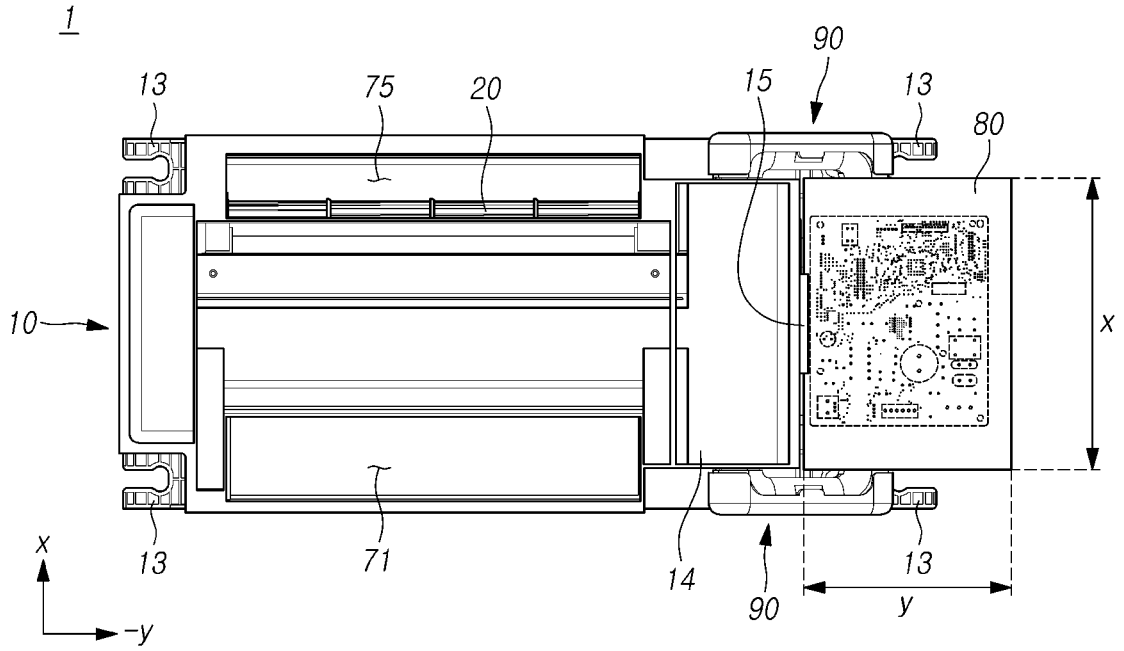
FIG. 3 is a view illustrating an air conditioner according to an embodiment of the disclosure installed on a ceiling with a ceiling panel removed, viewed from its bottom side.
Figure 4:
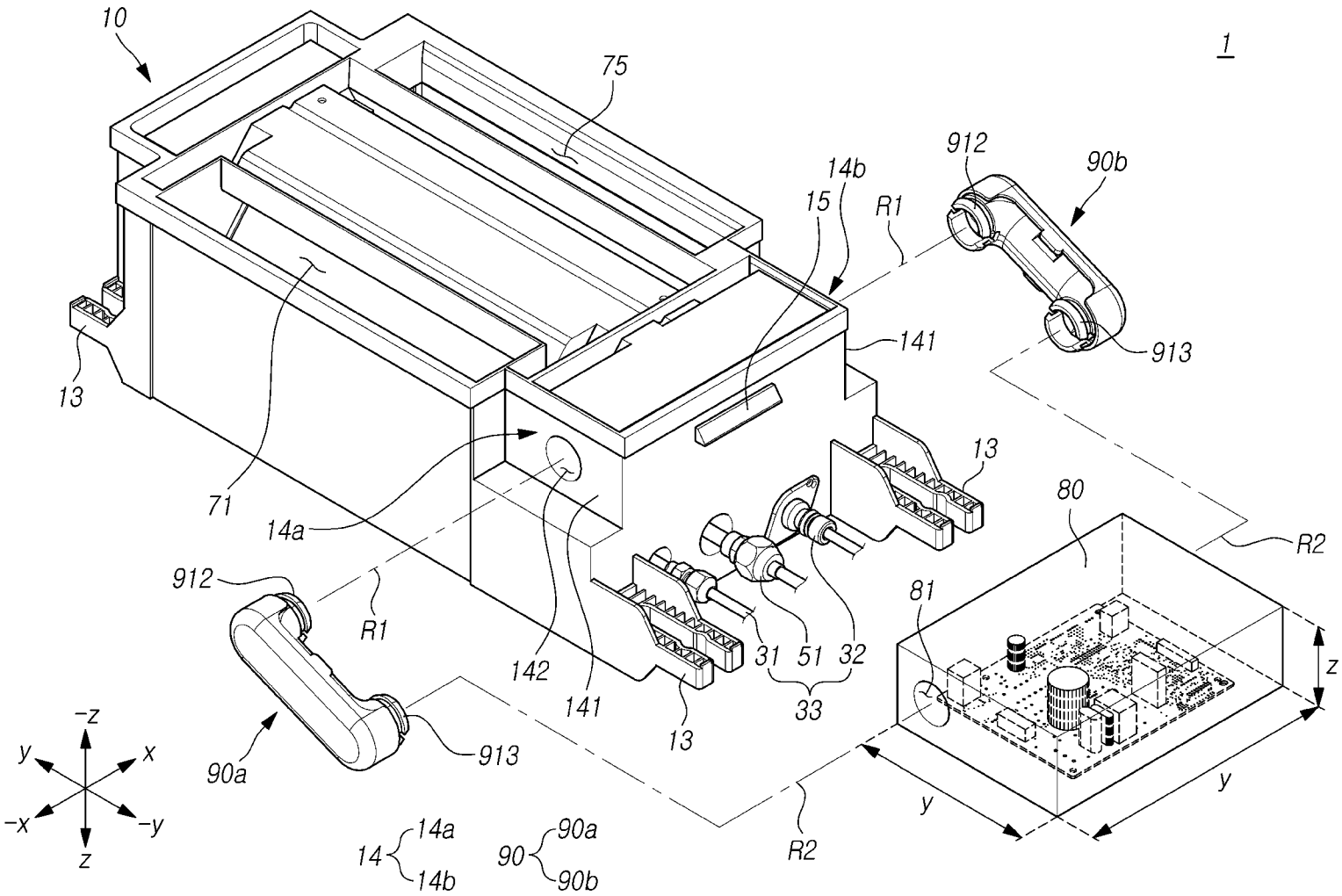
FIG. 4 is a view illustrating a control box and a link assembly of the air conditioner, illustrated in FIG. 3, separated from a housing.

FIG. 3 is a view illustrating an example of an air conditioner installed in a ceiling with its ceiling panel removed, viewed upwardly from the bottom side. FIG. 4 is a view illustrating a control box and a link assembly of the air conditioner, shown in FIG. 3, separated from the housing.

Hereinafter, in the description of the housing, as illustrated in FIG. 3, a side the air conditioner facing downward, in its installed state in the ceiling, will be referred to as a lower surface, and conversely, the side facing up towards the ceiling wall, opposite to the lower surface, will be referred to as an upper surface. Further, a surface connecting the lower surface and the upper surface in the intake port 71 side, with respect to the X-axis, may be referred to as a front surface, and a surface connecting the lower surface and the upper surface in the discharge port 75 side opposite thereto may be referred to as a rear surface. Further, when viewed from the front side, a surface connecting the front surface and the rear surface in the right side will be referred to as a right-side surface, and a surface connecting the front surface and the rear surface in the left side opposite thereto will be referred to as a left-side surface.

In an example, the air conditioner 1 may be installed to hang from an upper ceiling wall (not shown) above the ceiling surface (e.g., C in FIG. 2). According to an example, as illustrated in FIGS. 3 and 4, the housing 10 may include a plurality of hangers 13, supporting the housing 10, to have the air conditioner 1 to be fixedly installed on the ceiling wall. In an example, each of the plurality of hangers 13 may be arranged at edge(s) and/or corner(s) of the housing 10. In an example, each of the plurality of hangers 13 may be formed to protrude horizontally from each of a left side end and a right side end of the housing 10. Although not shown herein, each of the plurality of hangers 13 may be coupled to a support structure (not shown) fixed to the upper ceiling wall, such that the housing 10 may be stably connected in place.

Referring to FIGS. 3 and 4, in an example, the housing 10 may include a recessed portion 141, formed in recess toward the center along a predetermined section of the X-axis, in an outer part of a right-sided portion 14 disposed on its right side, when viewed from the front side (e.g., proximate to a bottom surface of the housing 10, along the Z-axis direction). In an example, the recessed portion 141 may be provided on each of a front surface 14*a* and rear surface 14*b* of the right-sided portion 14. According to an example, the housing 10 may include two recessed portions 141, each formed to be recessed from each of both sides of the front surface 14*a* and the rear surface 14*b* toward the center so as to face each other with respect to the X-axis direction. According to an example, each of the recessed portions 141 may provide a space in which the link assembly 90, to be described later, is disposed.

According to an example, each of the recessed portions 141 may include a first interlocking hole 142 in a vertical plane in a position formed in recess from the front surface or the rear surface toward the center along the X-axis direction. According to an example, a link assembly 90 (specifically, each of the link structures 90*a* and 90*b*), to be described later, may be disposed in each of the recessed portions 141, and a first connector 912 of the link assembly 90 (specifically, each of the link structures 90*a* and 90*b*), to be described later, may be inserted into each of the first interlocking holes 142 of the recessed portions 141. In an example, in a vertical plane of each of the recessed portions 141 of the right-sided portion 14 of the housing 10, the first interlocking hole 142 may be disposed to be biased toward the lower surface of the housing 10, but the disclosure is not limited thereto.

According to an example, a piping connection 33 may be provided on the right side of the housing 10. In an example, one or more pipe(s) (31, 32 and 51), connected from the inside of the housing 10, may be disposed outside the housing 10 in the piping connection 33. In an example, a first refrigerant pipe 31, through which the refrigerant flowing into the heat exchanger 30 flows, and a second refrigerant pipe 32, through which the refrigerant discharged from the heat exchanger 30 flows, may be disposed in the piping connection 33. In an example, a drain hose 51, connected to the drain 50 to discharge the condensed water contained in the drain 50 to the outside, may be disposed in the piping connection 33.

According to an example, a stopper 15 may be provided on the right-side surface of the housing 10 (e.g., the rightmost outer surface of the right-sided portion 14), and the disclosure is not limited thereto. In an example, the stopper 15 may be formed to protrude from the right-side surface. In an example, the stopper 15 may be provided in a triangular column shape to have a flat surface on its uppermost surface side (e.g., a side facing the Z-axis direction) and an inclined surface on its lowermost surface side (e.g., a side facing the −Z-axis direction), but the disclosure is not limited thereto. In an example, when the air conditioner 1 is in normal operation, a control box 80, to be described later, may be disposed below (e.g., in the −Z-axis direction) the piping connection 33, overlapping the piping connection 33 in the vertical direction. In such a case, as the control box 80 may come in contact with the stopper 15 thereby limiting its rotation, the control box 80 may be fixedly maintained in place.

According to an example, the air conditioner 1 may include the control box 80.

According to an example, the control box 80 may include a PCB Board Assembly (PBA) to control the operation of various components of the air conditioner 1, such as the blower fan 20. As illustrated in FIG. 3, in an example, the control box 80 may have a substantially rectangular parallelepiped (or cuboidal) shape with a length x in the X-axis direction, a length y in the Y-axis direction, and a length z in the Z-axis direction, and the disclosure is not limited thereto. As illustrated in FIGS. 3 and 4, the control box 80 may have a length z in the Z-axis direction that is shorter than the length x in the X-axis direction and the length y in the Y-axis direction, and the disclosure is not limited thereto. In an example, the PBA of the control box 80 may be electrically connected to each component of the air conditioner 1, such as the blower fan 20, through a wire (not shown). In an example, as illustrated in FIG. 3, the PBA substrate of the control box 80 may be disposed to face downwardly the lowermost surface of the housing 10 on the XY plane, while the air conditioner 1 is in its normal operation.

In an example, the control box 80 may be rotatably connected to the housing 10 through the link assembly 90. In an example, the position of the control box 80 with respect to the housing 10 may be variable by means of the link assembly 90. In an example, the control box 80 may be disposed at a position that does not interfere with the air flow, while the air conditioner 1 is in its normal operation. For example, the control box 80 may be disposed at a position (e.g., a position corresponding to a lower side of the piping connection 33 or a first position) vertically overlapping the piping connection 33, without covering or interfering with the intake port 71 or the discharge port 75. In an example, for example, when any work (e.g., installation or maintenance) is required for the piping connection 33 is required, the control box 80 may be moved to a position (e.g., a second position) that does not overlap or cover the piping connection 33 to allow the piping connection 33 to be sufficiently exposed for access by an operator. In an example, the control box 80 may be moved to a position toward the intake port 71 of the housing 10 to allow the piping connection 33 to be sufficiently exposed for access by an operator. For example, when the operation for the piping connection 33 is completed, the control box 80 may be moved back to its original position the position (e.g., the first position) vertically overlapping the piping connection 33, with manipulation of the operator.

According to an example, an interlocking hole 81 may be provided in each of the front surface and the rear surface of the control box 80. A second connector 913 of the link assembly 90, which will be described later, may be inserted into each of the interlocking holes 81.

According to an example, the air conditioner 1 may include a link assembly 90. According to an example, the link assembly 90 may include a pair of link structures 90*a* and 90*b*. In an example, each of the link structures 90*a* and 90*b* may be provided on the front and rear sides of the housing 10 and the control box 80, respectively. The link assembly 90 may include a first link structure 90*a* and a second link structure 90*b*. The first link structure 90*a* may connect a first side of the control box 80 to a first side of the housing 10. The second link structure 90*b* may connect a second side of the control box 80 to a second side of the housing 10.

According to an example, one end of each of the link structures 90*a* and 90*b* may be rotatably connected to the housing 10. In an example, each of the link structures 90*a* and 90*b* may have the first connector 912 and the second connector 913 described above. In an example, the first connector 912 of each of the link structures 90*a* and 90*b* may be inserted into or fitted into each of the first interlocking holes 142 provided in the right-sided portion 14 of the housing 10. In such a circumstance, a first rotation axis R1 may be defined connecting the first interlocking holes 142 on both sides of the housing 10. The link structures 90*a* and 90*b* may be rotated about the first rotation axis R1.

According to an example, the other end of each of the link structures 90*a* and 90*b* may be connected to the control box 80. In an example, the second connector 913 of each of the link structures 90*a* and 90*b* may be inserted into or fitted into the second interlocking hole 81 provided in the control box 80. In this connection, a second rotation axis R2 may be defined connecting the second interlocking holes 81 on both sides of the control box 80. The control box 80 connected to the link structures 90*a* and 90*b* may be rotated about the second rotation axis R2.

Figure 5:
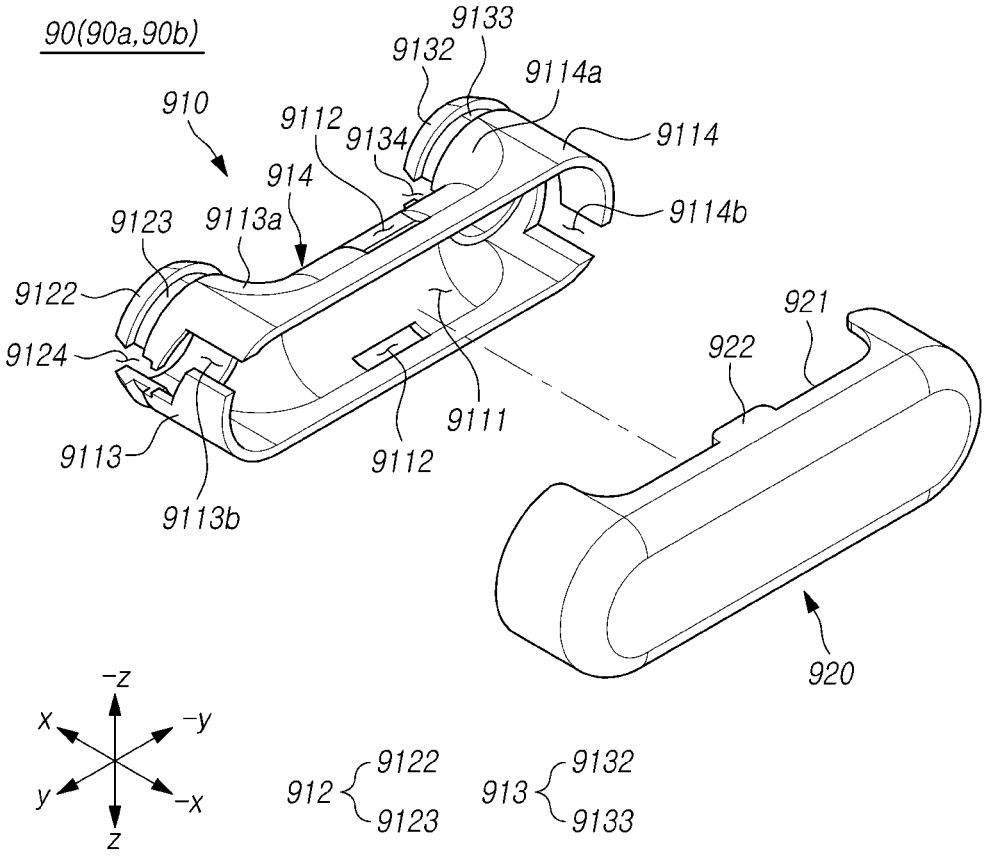
FIG. 5 is an exploded perspective view of a link structure according to an embodiment of the disclosure.
Figure 6:
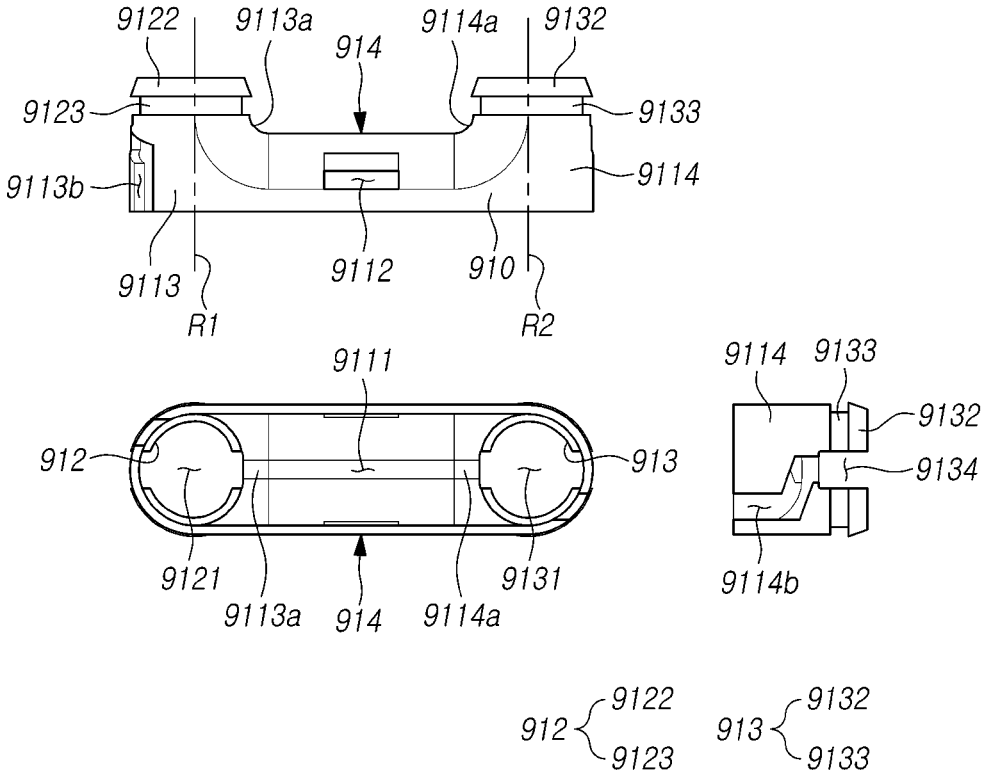
FIG. 6 is a view illustrating a link body of a link structure according to an embodiment of the disclosure, viewed from various angles.
Figure 7A:
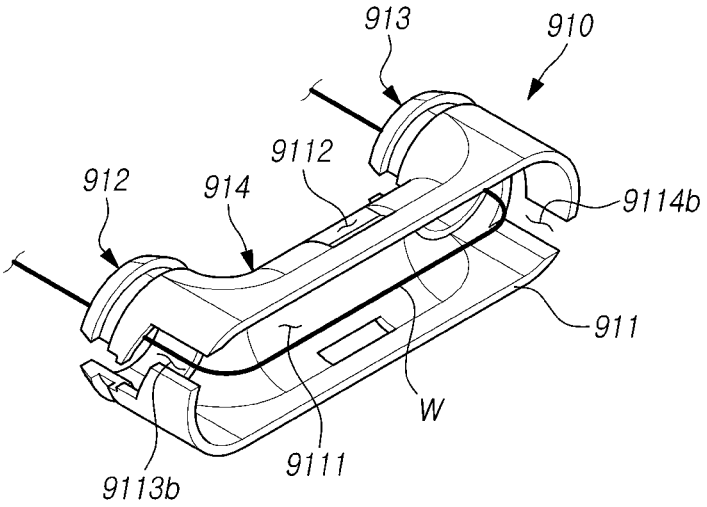
FIG. 7A is a view illustrating wires accommodated in a link body according to an embodiment of the disclosure.
Figure 7B:
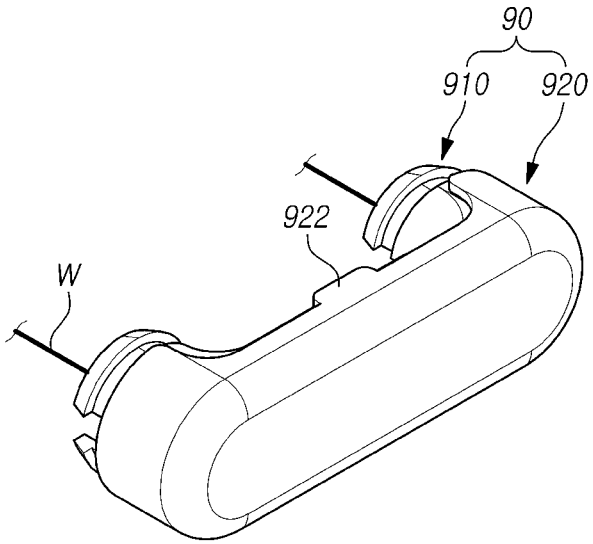
FIG. 7B is a view illustrating a link cover coupled to a link body, with wires being accommodated in the link body, according to an embodiment of the disclosure.

FIG. 5 is an exploded perspective view of a link structure according to an example. FIG. 6 is a view illustrating a link body of a link structure according to an example, viewed from various angles. FIG. 7A is a view illustrating wires accommodated in a link body. FIG. 7B is a view illustrating a link cover coupled to the link body, with wires being accommodated in the link body.

Referring to FIG. 5, FIG. 6, FIG. 7A, and FIG. 7B, in an example, each of the link structures 90*a* and 90*b* of the link assembly 90 may include a link body 910 and a link cover 920.

According to an example, the link body 910 may include the first connector 912 formed in an annular shape toward the X-axis direction, one end 9113 extending from the first connector 912 along the −X-axis, the second connector 913 formed in an annular shape toward the X-axis direction from the opposite side of the first connector 912, and the other end 9114 extending from the second connector 913 along the −X-axis. According to an example, the link body 910 may include a body 914 extending along the Y-axis between one end 9113 and the other end 9114 and forming the overall appearance of the link structures 90*a* and 90*b*.

According to an example, the body 914 of the link body 910 may be configured to receive an electric wire W therein. In an example, the body 914 of the link body 910 may be provided to have a substantially hollow structure. In an example, the body 914 of the link body 910 may include a wire receiving space 9111 with its one side being open and formed in recess inwardly in the X-axis direction.

According to an example, each of one surface (e.g., a surface facing the Z-axis direction) of the body 914 of the link body 910 and an opposite surface (e.g., a surface facing the −Z-axis direction) of the link body 910 may be provided with a fitting hole 9112 into which a fitting protrusion 922 of the link cover 920, which will be described later, is inserted or fitting-coupled. In an example, the fitting hole 9112 may be extended along the longitudinal direction (e.g., the Y-axis direction) of the body 914, but the present disclosure is not limited thereto.

According to an example, the one end 9113 of the link body 910 may be disposed to extend along the X-axis from the first interlocking hole 142 of the housing 10. According to an example, the one end 9113 may be connected to bend toward the body 914 extending along the Y-axis. In this connection, at least part of an inner side surface 9113*a* of the one end 9113 connected to the body 914 of the link body 910 may be formed to have a curved surface. In such a case, it is possible to prevent an excessive bending of the wire W received in the receiving space 9111 of the link body 910.

According to an example, a first wire slit 9113*b* formed to be opened laterally may be provided on one side surface (e.g., an outer surface facing the +Y-axis direction) of one end 9113 of the link body 910. In an example, the first wire slit 9113*b* may be formed to extend along the longitudinal direction (e.g., the X-axis direction) of the one end 9113 of the link body 910. In an example, the first wire slit 9113*b* may extend to bend at least two (2) times in another direction, but the disclosure is not limited thereto. In an example, the first wire slit 9113*b* may be in communication through an opening with a first elastic portion 9124, which will be described later.

According to an example, the other end 9114 of the link body 910 may be disposed to extend along the X-axis from the second interlocking hole 81 of the control box 80. According to an example, the other end portion 9114 may be connected to bend toward the body 914 extending along the Y-axis. In this case, at least part of an inner side surface 9114*a* of the other end 9114 connected to the body 914 of the link body 910 may be formed to have a curved surface. In that case, the excessive bending of the wire W received in the receiving space 9111 of the link body 910 can be prevented.

According to an example, a second wire slit 9114*b* formed to be opened laterally may be provided on one side surface (e.g., an outer surface facing the −Y-axis direction) of the other end 9114 of the link body 910. In an example, the second wire slit 9114*b* may extend along the longitudinal direction (e.g., the X-axis direction) of the other end 9114 of the link body 910. In an example, the second wire slit 9114*b* may bend and extended at least two (2) times in another direction, but the disclosure is not limited thereto. In an example, the second wire slit 9114*b* may be in open communication with a second elastic portion 9134, which will be described later.

According to an example, the first connector 912 may include an annular shape of a first interlocking protrusion 9122 and a first interlocking groove 9123. According to an example, a first wire hole 9121 may be defined by an annular shape of the first interlocking protrusion 9122 and the first interlocking groove 9123.

According to an example, the first interlocking protrusion 9122 may be a protrusion configured to protrude in an annular shape from a front end of the first connector 912. According to an example, the first interlocking groove 9123 may be formed to be recessed inwardly in its circumferential direction to form a predetermined step with the first interlocking protrusion 9122 behind the first interlocking protrusion 9122. In an example, the first interlocking protrusion 9122 and the first interlocking groove 9123 may together define a first wire hole 9121, which is a space surrounded by the first interlocking protrusion 9122 and the first interlocking 9123. In an example, the first wire hole 9121 may be disposed to be in open communication with the first interlocking hole 142 of the housing 10.

In one example, the first interlocking protrusion 9122 may be inserted into or fitted into the first interlocking hole 142 arranged in the right-sided portion 14 of the housing 10. In an example, the first interlocking protrusion 9122 may be provided to be elastic and lose shape (e.g., deformed) while being inserted into the first interlocking hole 142, provided in the right-sided portion 14 of the housing 10. In an example, each of both side surfaces (e.g., outer surfaces facing each of the +Y-axis direction and the −Y-axis direction) of the first connector 912 of the link body 910 may be provided with the first elastic portion 9124, which is formed to cross the side surfaces of the first interlocking protrusion 9122 and the first interlocking groove 9123. Although not specifically illustrated herein, the first interlocking protrusion 9122 may come in contact with the inner surface of the first interlocking hole 142 during the process of being inserted or fitted into the first interlocking hole 142 to lose shape (e.g., deformed) as it moves toward the first elastic portion 9124, and may be continuously inserted until it passes through the first interlocking hole 142, after which point, the first interlocking protrusion 9122 may be restored to its original shape to be locked and fixed to the first interlocking hole 142. Accordingly, the first interlocking protrusion 9122 may be prevented from being disengaging from the first interlocking hole 142.

According to an example, the second connector 913 may include an annular shape of a second interlocking protrusion 9132 and a second interlocking groove 9133. According to an example, a second wire hole 9131 may be defined by an annular shape of the second interlocking protrusion 9132 and the second interlocking groove 9133.

According to an example, the second interlocking protrusion 9132 may be a protrusion configured to protrude in an annular shape from the front end of the second connector 913. According to an example, the second interlocking groove 9133 may be configured to be recessed inwardly in the circumferential direction to form a predetermined step with the second interlocking protrusion 9132 behind the second interlocking protrusion 9132. In an example, the second interlocking protrusion 9132 and the second interlocking groove 9133 may together define the second wire hole 9131, which is a space surrounded by these. According to an example, the second wire hole 9131 may be disposed to communicate with the second interlocking hole 81 of the control box 80.

In an example, the second interlocking protrusion 9132 may be inserted into or inserted into the second interlocking hole 81 provided in the control box 80. In an example, the second interlocking protrusion 9132 may be provided to be elastic and lose shape (e.g., deformed) while being inserted into the second interlocking hole 81 provided in the control box 80. In an example, each of both side surfaces (e.g., the outer surfaces facing each of +Y direction and the −Y-axis direction) of the second connector 913 of the link body 910 may be provided with the second elastic portion 9134 formed to cross the side surfaces of the second interlocking protrusion 9132 and the second interlocking groove 9133. Although not specifically illustrated herein, the second interlocking protrusion 9132 may come into contact with the inner surface of the second interlocking hole 81 in the process of being inserted or fitted into the second interlocking hole 81. After coming into contact, the second interlocking protrusion 9132 may lose shape (e.g., deformed) as it moves towards the second elastic portion 9134 and may be continuously inserted until it passes through the second interlocking hole 81, after which point, the second interlocking protrusion 9132 may be restored to its original shape to be locked and fixed to the second interlocking hole 81. Accordingly, the second locking protrusion 9132 may be prevented from being separated from the second interlocking hole 81.

According to an example, a first rotation axis R1 may be defined in the first connector 912 of each of the link structures 90*a* and 90*b* disposed on both sides of the housing 10. In an example, in case where the first connector 912 of each of the link structures 90*a* and 90*b* is inserted or fitted into the first interlocking holes 142 respectively formed on the front and rear sides of the right-sided portion of the housing 10, the first rotation axis R1 may be defined connecting the center of the first wire hole 9121 of the first connectors 912. As the first wire hole 9121 communicates with the first interlocking hole 142 provided in the right-sided portion 14 of the housing 10 and accommodates the first rotation axis R1, it is possible to prevent damage caused by twisting and/or torsion of the wire W received in the link structures 90*a* and 90*b*, when the link structures 90*a* and 90*b* rotate about the first rotation axis R1. In an example, one end of the wire W received in the link body 910 may be connected to the inside of the housing 10 through the first wire hole 9121 and the first interlocking hole 142, which can be then electrically connected to respective components of the air conditioner 1, such as the blower fan 20.

According to an example, a second rotation axis R2 may be defined by the second connectors 913 of the link structures 90*a* and 90*b* disposed on both sides of the control box 80. In an example, in case where the second connectors 913 of each of the link structures 90*a* and 90*b* are inserted or fitted into the second interlocking holes 81 respectively formed on the front and rear sides of the control box 80, the second rotation axis R2 may be defined connecting the center of the second wire hole 9131 of each of the second connectors 913. As the second wire hole 9131 is formed to communicate with the second interlocking holes 81 on both sides of the control box 80 and receive the second rotation axis R2, it is possible to prevent the damage caused by twisting and/or torsion of the wire W received in the link structures 90*a* and 90*b*, when the control box 80 rotates about the second axis of rotation R2. In an example, the other end of the wire W accommodated in the link body 910 may be connected to the inside of the control box 80 through the second wire hole 9131 and the second interlocking hole 81, and then, may be electrically connected to respective electrical components of the PBA provided in the control box 80.

In an example, each of the link structures 90*a* and 90*b* of the link assembly 90 may include the link cover 920.

According to an example, the link cover 920 may be configured to surround an open surface (e.g., a surface through which the wire receiving space 9111 is exposed to the outside) of the body 914 of the link body 910, and an outer circumferential surface of each of the opposite end portions 9113 and 9114. In an example, an upper surface (e.g., a surface facing the Z-axis direction) or a lower surface (e.g., a surface facing the −Z-axis direction) of the link cover 920 may include a cut-out portion 921 cut inwardly of the link cover 920. According to an example, the link cover 920 may have an open surface of the body 914 of the link body 910, and an inner recessed space surrounding and accommodating the outer circumferential surface of each of the opposite end portions 9113 and 9114.

According to an example, the link cover 920 may be detachably coupled to the link body 910, facing and approaching the wire receiving space 9111 of the link body 910 (along the X-axis direction). In an example, the link cover 920 may be coupled to the link body 910 to block the wire receiving space 9111 of the link body 910 from the outside. In an example, the cut-out portion 921 of the link cover 920 may be provided with the fitting protrusion 922 formed to protrude toward the fitting hole 9112 of the link body 910. In an example, although not specifically illustrated herein, the fitting protrusion 922 may have a hook structure capable of being caught and fixed to the fitting hole 9112 of the link body 910, when the link body 910 and the link cover 920 are coupled to each other, but the disclosure is not limited thereto. In this case, the wire W accommodated in the wire receiving space 9111 of the link body 910 may be blocked from the outside for protection.

According to an example, although not specifically illustrated herein, before each of the link structures 90*a* and 90*b* of the link assembly 90 is coupled to each of the housing 10 and the control box 80, the wire W may be inserted into the wire receiving space 9111 of the link body 910 through the wire holes 9121 and 9131 and the wire slits 9113*b* and 9114*b* provided in the link body 910. The wire W may be fitted into its intended position as it passes through the first wire hole 9121, the wire receiving space 9111, and the second wire hole 9131 (see FIG. 7A). In an example, the link cover 920 may be disposed to surround or cover the open surface of the body 914 of the link body 910 and the outer circumferential surface of each of the opposite end portions 9113 and 9114. In an example, the fitting protrusion 922 of the link cover 920 may be inserted or fitted into the fitting groove 9112 provided in the link body 910, to allow the wire receiving space 9111 of the link body 910 to be blocked from the outside (see FIG. 7B). Then, the wiring and assembly of the link assembly 90 may be completed by coupling each of the first and second connections 912 and 913 of the link structures 90*a* and 90*b* to the housing 10 and the control box 80, respectively.

In an example, the above-described wiring work may be performed by first being coupled to the housing 10 and the control box 80 in a state in which the wire W is connected to the link body 910 of each of the link structures 90*a* and 90*b*, and then coupling the link cover 920 to the link body 910. The wire W connecting the housing 10 and each electrical component of the control box 80 may be protected by the link body 910 and the link cover 920 from external physical factor(s). Further, the wire W connecting the housing 10 and each electrical component of the control box 80 may maintain its shape by the link body 910 and the link cover 920, even when a relative rotation of the housing 10 and the control box 80 occurs.

Figure 8:
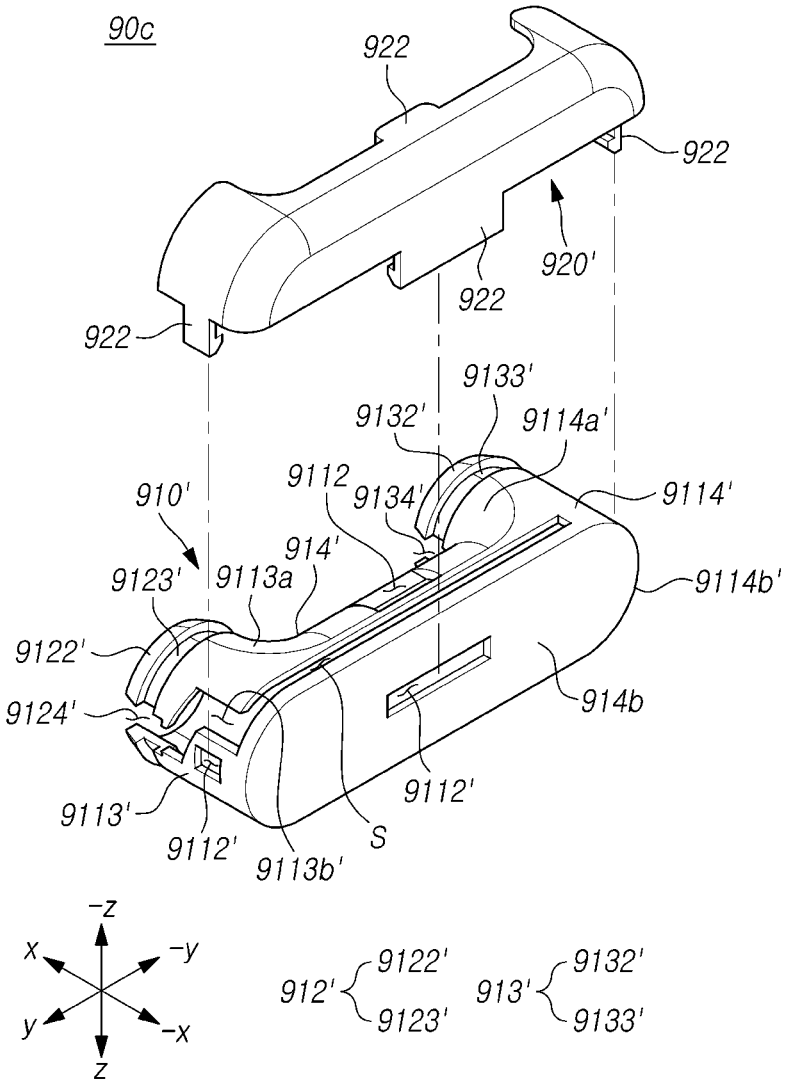
FIG. 8 is an exploded perspective view of a link structure according to an embodiment of the disclosure.

FIG. 8 is an exploded perspective view of a link structure according to an example.

A link structure 90*c* illustrated in FIG. 8 may include a link body 910' and a link cover 920'. The link structure 90*c* illustrated in FIG. 8 may have a structure substantially similar to the link structures 90*a* and 90*b* illustrated in FIGS. 5 to 7. In an example, similarly to the case of the link structures 90*a* and 90*b* of FIGS. 5 to 7, the link body 910' may include a first connector 912' formed in an annular shape in the X-axis direction, one end 9113' extending from the first connector 912' along the −X-axis, a second connector 913' of an annular shape disposed side by side with the first connector 912' in the X-axis direction opposite to the first connector 912', and the other end 9114' extending from the second connector 913' along the −X-axis. According to an example, the link body 910' may include a body 914' extending along the Y-axis between one end portion 9113' and the other end portion 9114' to form the overall appearance of the link body 910'. According to an example, a wire receiving space, in which the wire W may be received, may be provided inside the body 914' of the link body 910'.

In an example, similar to the link structures 90*a* and 90*b* of FIGS. 5 to 7, the first connector 912' of the link structure 90*c* may include an annular shape of a first interlocking protrusion 9122' and a first interlocking groove 9123'. According to an example, a first wire hole may be defined by an annular shape of the first interlocking protrusion 9122' and the first interlocking groove 9123'. The second connector 913' of the link structure 90*c* may include an annular shape of a second interlocking protrusion 9132' and a second interlocking groove 9133'. According to an example, a second wire hole may be defined by an annular shape of the second interlocking protrusion 9132' and the second interlocking groove 9133'.

In an example, similar to the link structures 90*a* and 90*b* of FIGS. 5 to 7, the link structure 90*c* may include first and second elastic portions 9124' and 9134' formed as an opening in each of the first and second connectors 912' and 913'. In an example, similar to the link structures 90*a* and 90*b* of FIGS. 5 to 7, the link structure 90*c* may include first and second wire slits 9113*b'* and 9114*b'* respectively formed at opposite ends 9113' and 9114' of the link body 910'. In an example, each of the first and second wire slits 9113*b'* and 9114*b'* may be configured to be in open communication with each of the first and second elastic portions 9124' and 9134'.

However, in case of the link structures 90*a* and 90*b* of FIGS. 5 to 7, the rear surface of the wire receiving space 9111 of the body 914 is open as a whole, whereas in the link structure 90*c*, a slit-shaped open space S recessed extending along the Y-axis direction from one surface facing the Z-axis is formed on one side of the body 914', and the rear surface 914*b'* of the wire receiving space inside the body 914' has a closed shape. According to an example, the first and second wire slits 9113*b'* and 9114*b'* of the link body 910' may be connected to the open space S, respectively. According to an example, the wire W may be inserted into the wire receiving space through the first wire slit 9113*b'*, the open space S, and the second wire slit 9114*b'*. Although not specifically illustrated herein, the wire W may pass through the first wire hole 9121', the wire receiving space, and the second wire hole 9131' and fitted into its intended position.

In case of the link structures 90*a* and 90*b* of FIGS. 5 to 7, the link cover 920 may face the wire receiving space 9111 of the link body 910 and move closer (along the X-axis direction) to be coupled to the link body 910, whereas the link structure 90*c* illustrated in FIG. 8 is different in that the link cover 920' approaches the link body 910' from above the link body 910' along the Z-axis direction to be coupled to the link body 910'. According to an example, as illustrated, the link cover 920' may be configured to cover the open space S of the body 914', and the first and second wire slits 9113*b'* and 9114*b'*. According to an example, a fitting hole 9112' may be formed near where the open space S is formed in the body 914' of the link body 910'. According to an example, the fitting hole 9112' may be formed below each of the wire slits 9113*b'* and 9114*b'* at both ends 9113' and 9114', respectively. According to an example, the fitting hole 9112' may also be formed in the center of the rear surface 914*b* of the body 914'.

According to an example, when the link cover 920' is coupled to the link body 910', the link cover 920' may have a hook-structure of fitting protrusion 922' in each region disposed to correspond to each fitting hole 9112' of the above-described body 914'. When the link cover 920' and the link body 910' are coupled to each other, each fitting protrusion 922' may be hooked and fixed to its respective corresponding fitting hole 9112'.

Heretofore, referring to FIGS. 5 to 8, the structure of some exemplary link structures has been described, but the disclosure is not limited thereto. According to various embodiments of the disclosure, various link structures of different shapes and structures may be used.

Figure 9:
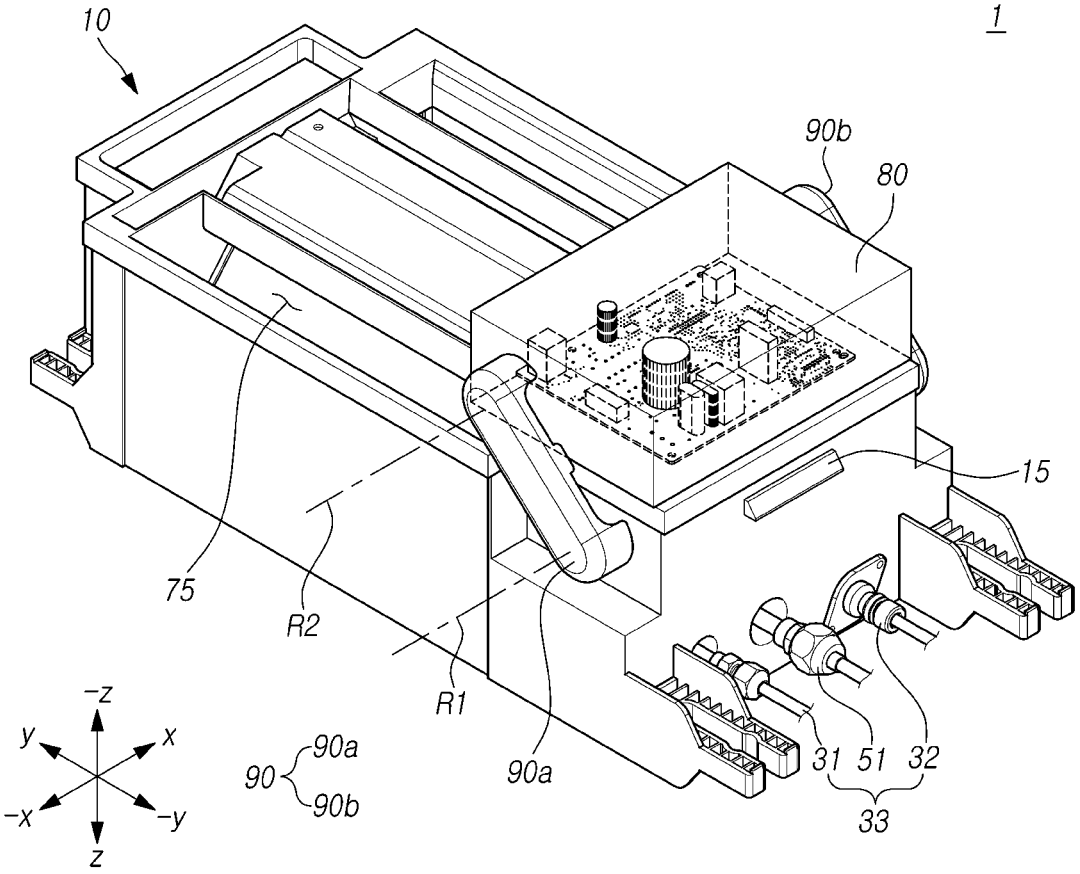
FIG. 9 is a view illustrating an air conditioner with a control box disposed with an exposed piping connection, according to an embodiment of the disclosure.
Figure 10:
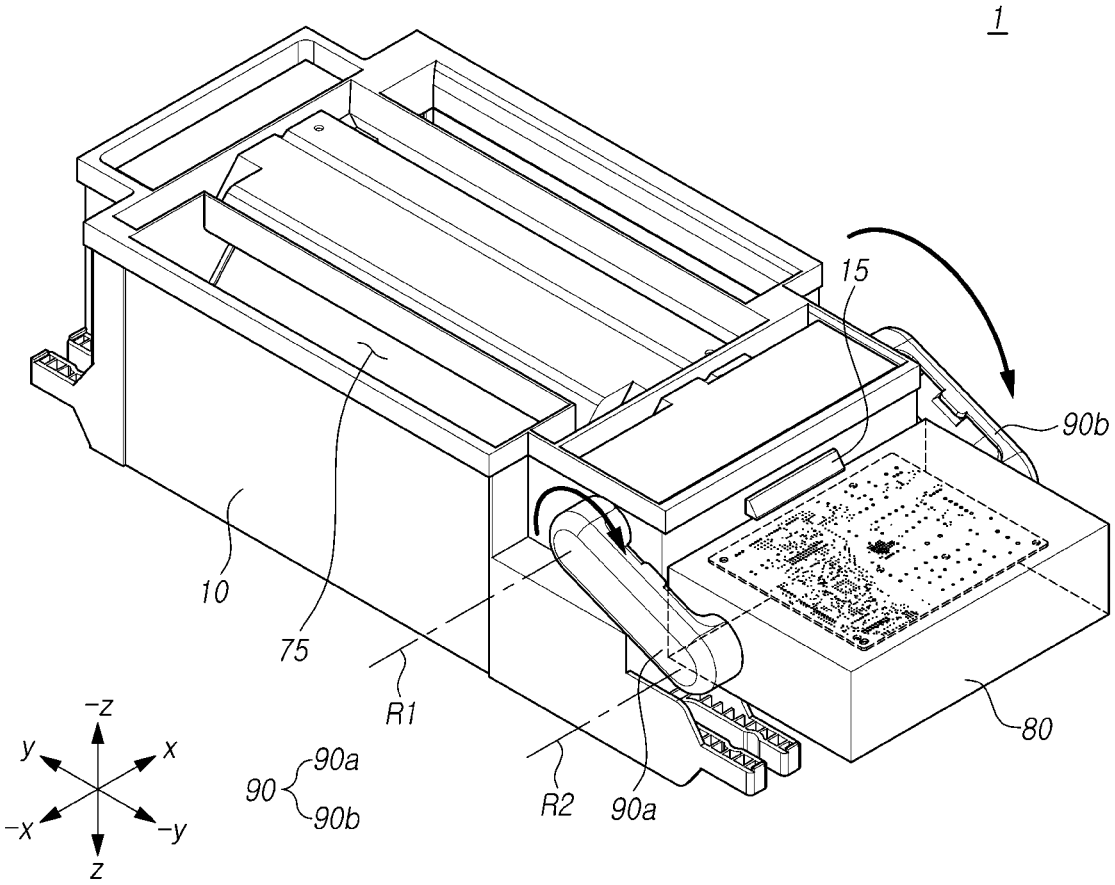
FIG. 10 is a view illustrating a relocated/repositioned control box on a piping connection in the air conditioner of FIG. 9 according to an embodiment of the disclosure.
Figure 11:
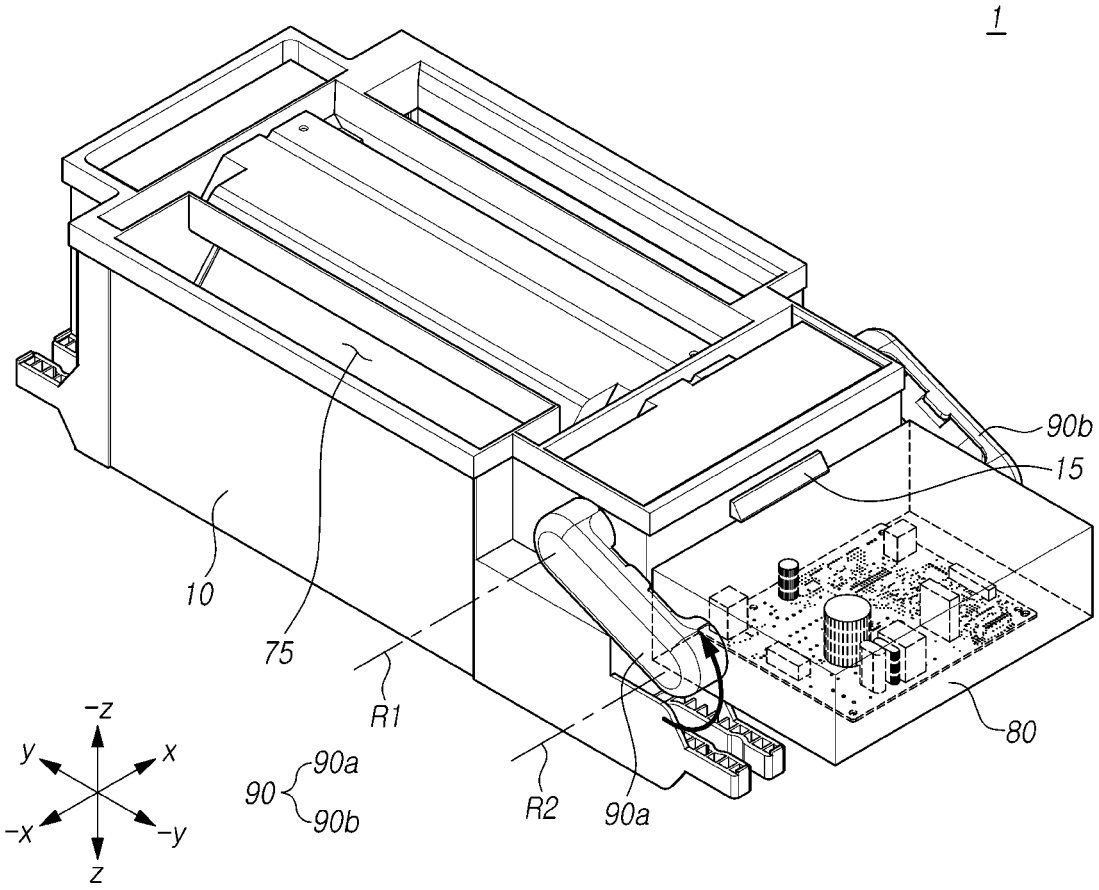
FIG. 11 is a view illustrating a control box rotated to its intended or predetermined position in preparation for normal operation of the air conditioner of FIG. 9 according to an embodiment of the disclosure.

FIG. 9 is a view illustrating an air conditioner with a control box disposed such that a piping connection is exposed, according to an example. FIG. 10 is a view illustrating the control box re-positioned on a piping connection in the air conditioner of FIG. 9. Further, FIG. 11 is a view illustrating the control box rotated to its intended or predetermined position in preparation for a normal operation of the air conditioner of FIG. 9.

Referring to FIG. 9, the control box 80 is disposed so that it does not cover the piping connection 33 in the event that piping is required for installation or maintenance of the air conditioner 1. Although not specifically illustrated herein, an operator may approach one side of the housing 10 of the air conditioner 1 provided with the piping connection 33, after removing the ceiling panel (referred to as 70 of FIG. 1) of the air conditioner 1 from the housing 10. As illustrated, the control box 80 may be disposed at a position adjacent to the intake port 71 of the housing 10, away from the region of the piping connection 33 where the refrigerant pipes 31 and 32 and/or the drain hose 51 are disposed. In such a circumstance, the operator may secure a sufficient field of view and workspace for each of the pipes 31, 32, and 52 of the piping connection 33, thereby enabling the operator to perform the maintenance work with ease. According to an example, when any maintenance work is required while the control box 80 is positioned in the lower area of the piping connection 33, the control box 80 may be rotated and moved to a position that does not interfere with the piping connection 33 (or cause the piping connection 33 to be exposed more) through rotation of the link assembly 90. In an example, the link assembly 90 may be rotated about the first rotation axis R1, and may move the control box 80 connected thereto, for example, between a position below the piping connection 33 and a position (e.g., the area adjacent to the intake port 71) of the control box 80 illustrated in FIG. 9.

Referring to FIG. 10, it is shown a state that the control box 80 is disposed at a position overlapping the piping connection 33 in the vertical direction. For example, in case where the piping work of the air conditioner 1 has been completed in the state illustrated in FIG. 9, the control box 80 that was disposed adjacent to the intake port 71 of the housing 10 may be moved to its original position, that is, the area below the piping connection 33. As described above, the link assembly 90 may rotate about the first rotation axis R1 and move the control box 80 connected thereto from the position of the control box 80 illustrated in FIG. 9 (e.g., the area adjacent to the intake port 71) to the area below the piping connection 33 illustrated in FIG. 10.

In an example, in case where the position of the control box 80 moves according to the rotation of the link assembly 90 about the first rotation axis R1, the top and bottom sides of the control box 80 may be inverted. In FIG. 11, according to an example, it is illustrated that the control box 80 is rotated about the second rotation axis R2 from that of FIG. 10, to be again rotated upside down. Accordingly, during the normal operation of the air conditioner 1, the control box 80 may be disposed below the piping connection 33 to overlap the piping connection 33 vertically, so as not to interfere with the air flow path such as the intake port 71 or the discharge port 75. In this case, the PBA substrate of the control box 80 may be positioned in place to face a bottom of the ceiling surface.

In an example, the control box 80 located below the piping connection 33 may be hooked and fixed by the stopper 15. According to an example, as illustrated, the stopper 15 may be provided in a triangular column shape having a flat surface on its upper side (e.g., a side facing the Z-axis direction) and an inclined surface on its lower side (e.g., a side facing the −Z-axis direction). Accordingly, when the control box 80 is moved from a space out of the piping connection 33, for example, in a space adjacent to the intake port 71 as illustrated in FIG. 9, to a space overlapping the piping connection 33, by its rotation about the first rotation axis R1 of the link assembly 90, the control box 80 may be moved rotating along the inclined surface of the stopper 15. In the meantime, while the control box 80 is located in the space overlapping the piping connection 33, the control box 80 may be come into contact with the flat surface of the stopper 15 to restrict the rotation, and thus, the control box 80 may be fixed in the position below the piping connection 33 (e.g., in the −Z-axis direction). According to an example, the control box 80 located at the bottom of the piping connection 33 may come into contact with the stopper 15, thereby preventing it from rotationally moving under its own weight during operation of the air conditioner 1.

In an example, the stopper 15 may be formed of an elastic member. In an example, when the control box 80 is disposed below the piping connection 33 and comes into contact with an upper surface of the stopper 15, the rotation of the control box 80 may be limited by the stopper 15 and the position of the control box 80 may be maintained in a fixed state, as described above, unless any external force is applied. However, when the user applies an external force for rotation as required, such as for installation or maintenance, the control box 80 may rotate back again beyond the stopper 15 to a position where the piping connection 33 is exposed.

Unlike the illustrated configuration, according to an example, the air conditioner 1 may include a stopper having a different configuration for fixing the position of the control box 80. For example, rotation of the link structures 90*a* and 90*b* may be prevented by hooking between the first connector 912 or the second connector 913 of the link structures 90*a* and 90*b* and the protrusion (and the stopper structure) formed in the first interlocking hole 142 or the second interlocking hole 81 abutting thereon.

As an example only, although not illustrated in the drawings, a protrusion may be formed in a predetermined region around the first interlocking groove 9123 of the link structures 90*a* and 90*b*, and a guide structure (e.g., a guide groove), capable of guiding the rotational movement of the protrusion when the link structures 90*a* and 90*b* rotate along the first rotation axis R1, may be formed in the first interlocking hole 142 of the housing 10 contacting the first interlocking groove 9123. Although not illustrated herein, the first interlocking hole 142 may include a first stopper structure formed in a region between the first interlocking hole 142 and the guide structure thereof, and a second stopper structure formed in an region opposite to the region where the first stopper structure is formed, with respect to a region (hereinafter, referred to as a protrusion-corresponding area) coming into contact with the protrusion of the first interlocking groove 9123, when the link structures 90*a* and 90*b* have been inserted into the first interlocking hole 142. For example, in the first interlocking hole 142 may be formed a first stopper structure and a second stopper structure, with the protrusion-corresponding area interposed therebetween.

In an example, the protrusion or the first and second stopper structures may be formed of an elastic member. In an example, the first interlocking protrusion 9122 of the link structure 90*a* may be inserted into the first interlocking hole 142 of the housing 10, providing the protrusion of the first interlocking groove 9123 to be disposed in the protrusion-corresponding area between the first and second stopper structures. In an example, when the user applies an external force for rotating the link structures 90*a* and 90*b* about the first rotation axis R1, the protrusion of the first interlocking groove 9123, described above, may extend beyond the first stopper structure to enter the guide structure. The protrusion may enter the guide structure and then rotate along the guide structure. At the end of the rotation, the protrusion of the first interlocking groove 9123 may return to the position between the first and second stopper structures beyond the second stopper structure (e.g., the original position). Accordingly, the rotation of the link structures 90*a* and 90*b* may be ceased and the control box 80 may reach a desired position. In this state, without additional external force, the protrusion of the first interlocking groove 9123 is caught by and between the first and second stopper structures, prevented from moving in either directions. Hence, the rotation of the link structures 90*a* and 90*b* may be ceased and the control box 80 may be maintained in place, i.e., its regular/original position. In an example, if an external force is applied again, the protrusion of the first interlocking groove 9123 may enter the guide structure beyond the first or second stopper structure and may rotate again to a desired position along the guide structure. Such a structure of the protrusion and the first and second stoppers have been described with regard to the first interlocking groove 9123 and the first interlocking hole 142, but the same configuration may be also applied to the second interlocking groove 9133 and the second interlocking hole 81. In addition, such a configuration of the protrusion and the first and second stopper is only of an example, and more various stopper structures may be used.

Although not specifically illustrated herein, according to an example, after the installation or repair work is completed, the ceiling panel 70 of the housing 10 may be coupled, with the control box 80 arranged below the piping connection 33, as illustrated in FIG. 11. Accordingly, during the operation of the air conditioner 1, the control box 80 is fixedly disposed at a position that does not interfere (or overlap) with the intake port 71 or the discharge port 75, thereby not interrupting the air flow through the intake port 71 or the discharge port 75, leading to improved performance of the air conditioner 1.

Figure 12:
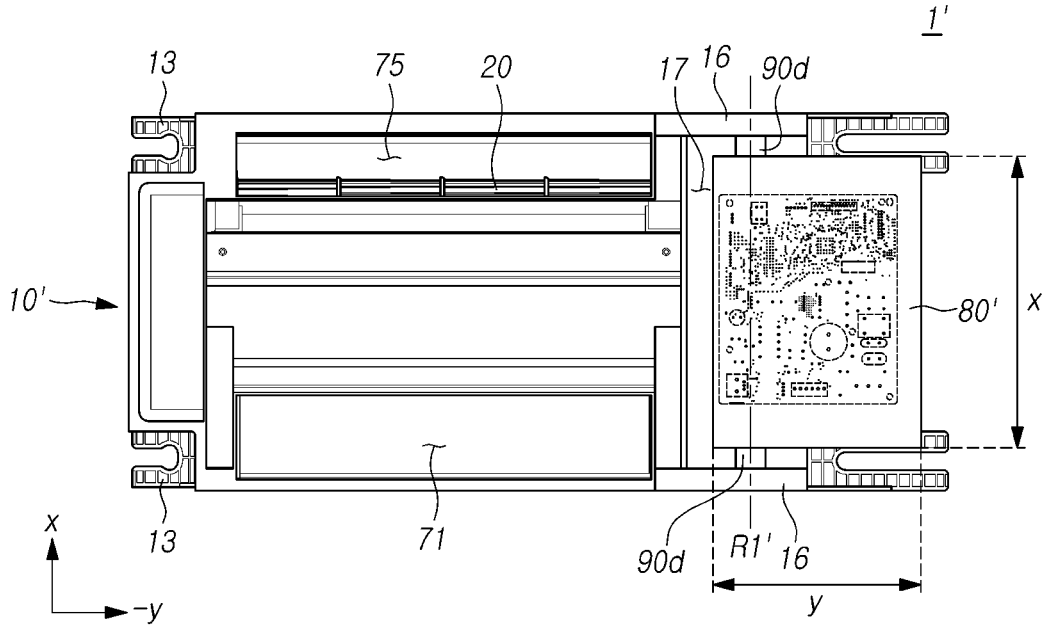
FIG. 12 is a view illustrating an air conditioner according to an embodiment of the disclosure installed on a ceiling with its ceiling panel removed, viewed from a bottom side.
Figure 13:
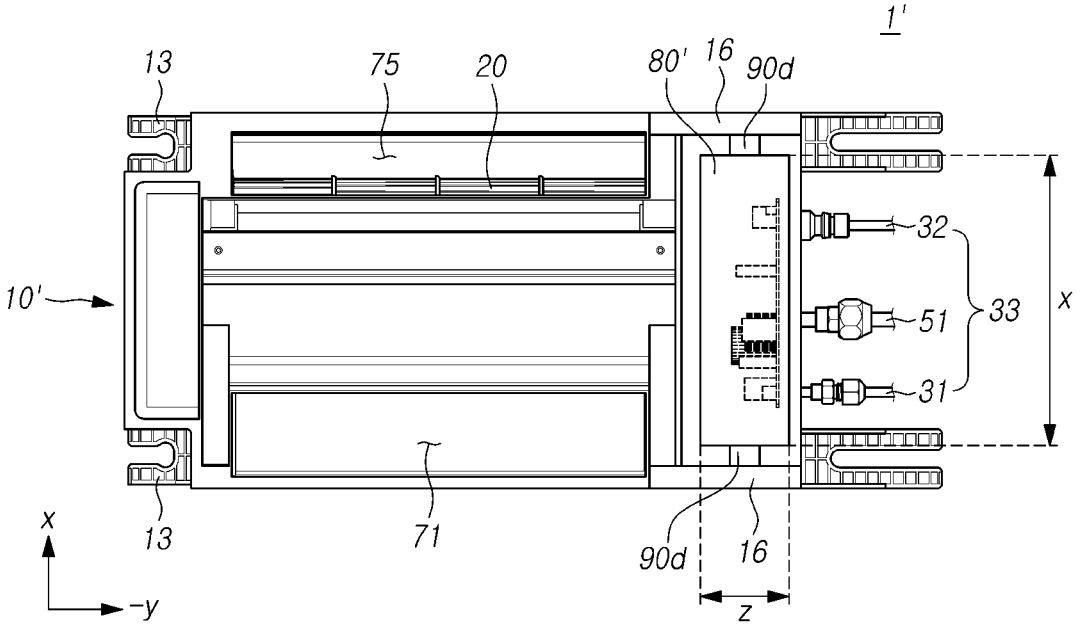
FIG. 13 is a view illustrating a control box disposed in a way for piping connection to be exposed in the air conditioner shown in FIG. 12 according to an embodiment of the disclosure.
Figure 14:
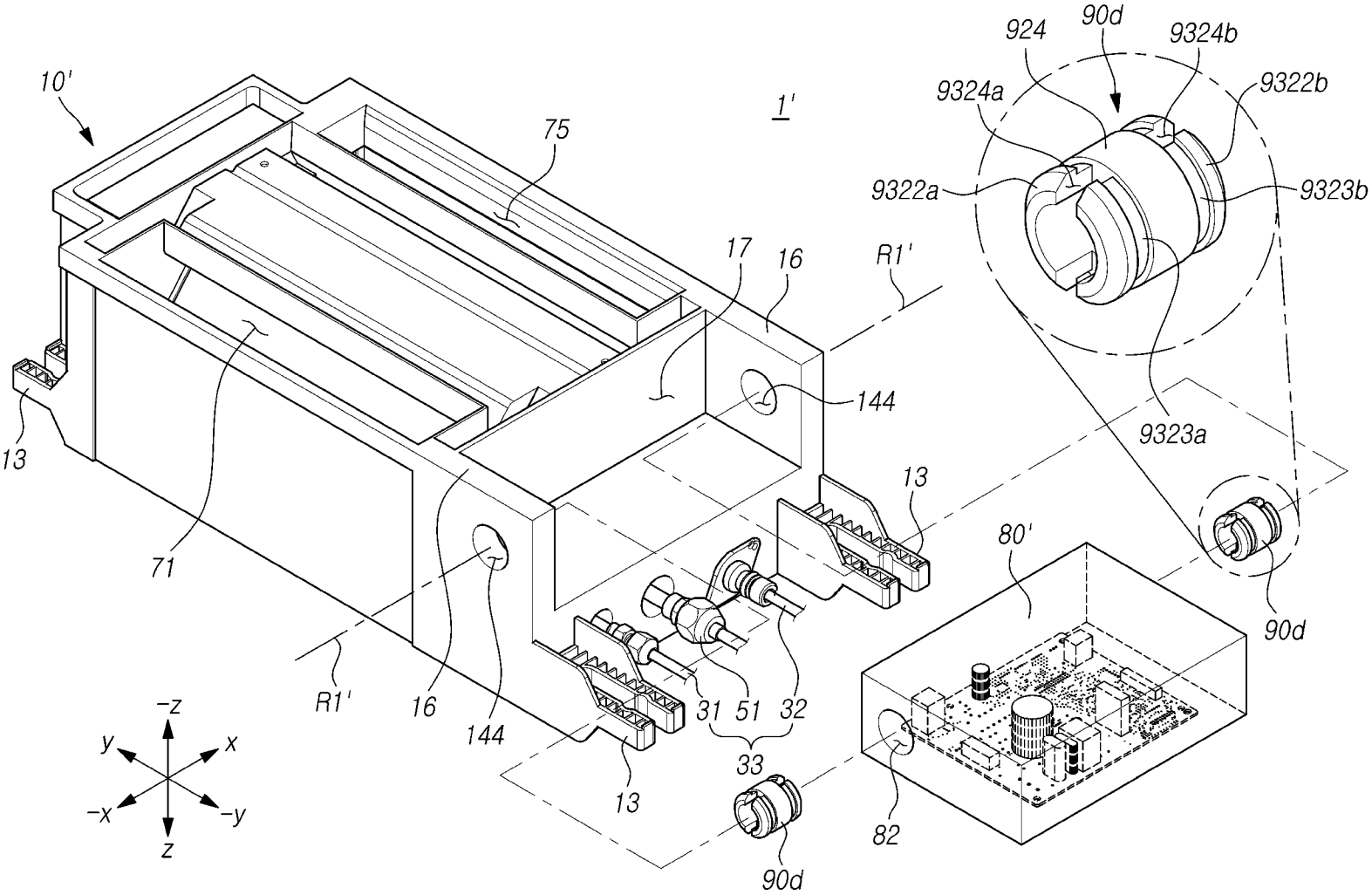
FIG. 14 is an exploded view illustrating a control box of the air conditioner, shown in FIGS. 12 and 13, separated from the housing according to an embodiment of the disclosure.

FIG. 12 is a view illustrating an air conditioner, according to an example, installed on a ceiling with a ceiling panel removed, viewed from a bottom side. FIG. 13 is a view illustrating a control box disposed with an exposed piping connection in the air conditioner shown in FIG. 12. FIG. 14 is an exploded view illustrating a control box of the air conditioner shown in FIGS. 12 and 13 separated from the housing.

Heretofore, referring to FIGS. 3 to 11, descriptions have been made of the embodiments in which the control box 80 of the air conditioner 1 is connected to the housing 10 by a pair of link structures 90*a* and 90*b*, each having two connectors 912 and 913, that is, the link assembly 90, rotating about each of the two rotation axes R1 and R2 and moving between a position vertically overlapping the piping connection 33 and another position exposing the piping connection 33. In the case of the air conditioner 1' according to the embodiment described with reference to FIGS. 12 to 14, the control box 80' may rotate about one rotation axis R1', formed between the control box 80' and the housing 10', to move between the position vertically overlapping the piping connection 33 and the position exposing the piping connection 33.

Referring to the illustration of FIGS. 12 and 13, the air conditioner 1' includes a housing 10'. As illustrated, in an example, the housing 10' may include an extension portion 16, in which a front plate making up a front surface of the housing 10' and a rear plate making up a rear surface of the housing 10 extend to the right side in the right-sided portion where the intake port 71 and the discharge port 75 are arranged. The extension portion 16 on each of the front and rear sides may form a space 17 recessed toward the right-side surface of the housing 10' between them. At least a part of the control box 80' may be disposed in the space 17. Similar to the control box 80 described above, the control box 80' may have a rectangular parallelepiped shape (or cuboidal) and may include a PBA therein. As illustrated in FIG. 12, during a normal operation of the air conditioner 1', the PBA substrate of the control box 80 may be disposed to face downward with respect to the bottom surface of the housing 10' on the XY plane. Similar to the control box 80 described above, the control box 80' may have a substantially rectangular parallelepiped shape having an X-axis direction of length x, a Y-axis direction of length y, and a Z-axis direction of length z. In an example, the length z in the Z-axis direction may be shorter than the length x in the X-axis direction and the length y in the Y-axis direction.

Referring to FIGS. 12 and 13, the air conditioner 1' may include a link structure 90*d* connecting the control box 80' to the extension portion 16 of each of the front surface and the rear surface of the housing 10'. In an example, the control box 80' may be connected to the housing 10' by each link structure 90*d* on both sides of the front surface and the rear surface and may rotate about the first rotation axis R1' defined by the link structure 90*d* on both sides. For example, as illustrated in FIG. 12, the control box 80' may rotate 90 degrees clockwise about the first rotation axis R1', with the PBA substrate included therein being disposed toward the bottom side of the housing 10' along the XY plane at the position (e.g., the lower side of the piping connection 33) vertically overlapping the piping connection 33. By the rotation, the control box 80' may be in a state in which the PBA substrate included therein is extended along the −Z axis, facing left along the XZ plane, as shown in FIG. 13. As illustrated, in FIG. 12, the control box 80' may overlap the piping connection 33 by length y in the Y-axis direction with respect to the XY plane, and in FIG. 13, the control box 80' may overlap the piping connection 33 by length z in the Z-axis direction with respect to the XY plane. As described above, since length z in the Z-axis direction is shorter than length y in the Y-axis direction, the piping connection 33 in FIG. 13 may be further exposed downward by a difference between the two lengths compared to that of FIG. 12. For example, as illustrated in FIG. 13, each of the pipes (31, 32, and 51) of the piping connection 33 are exposed behind the control box 80', when viewed from the lower side.

Referring to FIG. 14, the structure of connection between the housing 10' and the link structure 90*d* of the control box 80' may be more clearly understood. The link structure 90*d* may include a body 924 and a pair of first and second interlocking protrusions 9322*a* and 9322*b*, formed on both sides of the body 924. The link structure 90*d* may include a pair of first interlocking grooves 9323*a* that form a predetermined step between the first interlocking protrusion 9322*a* and the body 924 and are recessed inwardly in the circumferential direction. In an example, the link structure 90*d* may include a first interlocking protrusion 9322*a* and a first elastic portion 9324*a* formed open to cross a side surface of the first interlocking groove 9323*a*. The link structure 90*d* may also include a second interlocking protrusion 9322*b*, a second interlocking groove 9323*b*, and a second elastic portion 9324*b* corresponding to the first interlocking protrusion 9322*a*, the first interlocking groove 9323*a*, and the first elastic portion 9324*a*, respectively, opposite to the body 924.

In an example, the piping connection 33 may be disposed near the front end, in the Z-axis direction, between respective extension parts 16 of the front surface and the rear surface of the housing 10' close to the top surface of the housing 10'. For example, the first and second refrigerant pipes 31 and 32 and the condensate drain hose 51 may be disposed in the piping connection 33, but the disclosure is not limited thereto.

In an example, in each of the extension portions 16 of the front surface and the rear surface, interlocking holes 144 may be formed on a surface facing the space 17, near the front end, in the −Z-axis direction, close to the bottom surface of the housing 10'. A portion of the above-described link structure 90*d*, for example, the first interlocking protrusion 9322*a* may be inserted into each interlocking hole 144 of each extension portion 16. In an example, the first interlocking protrusion 9322*a* may be inserted into or fitted into the first interlocking hole 144 provided in the extension portion 16 of the housing 10'. In an example, the first interlocking protrusion 9322*a* may be provided to be elastic and lose shape (e.g., deformed) during the process of being inserted into the first interlocking hole 144 of the housing 10'. In an example, when the first interlocking protrusion 9322*a* is inserted into or fitted into the first interlocking hole 144, the first interlocking protrusion 9322*a* may come into contact with the inner surface of the first interlocking hole 142 to lose its shape (e.g., deformed) as it moves towards the first elastic portion 9324*a*, and may be continuously inserted into the first interlocking hole 144 until it passes through the first interlocking hole 144, after which point, the first interlocking protrusion 9322*a* may be restored to its original shape to be caught and locked to the first interlocking hole 144. Hence, it is possible to prevent the first interlocking protrusion 9322 from being separated from the first interlocking hole 144.

In an example, a second interlocking hole 82 may be formed in each of the front surface and the rear surface of the control box 80'. A portion of the above-described link structure 90*d*, for example, the second interlocking protrusion 9322*b*, may be inserted into each of the second interlocking holes 82. In an example, the second interlocking protrusion 9322*b* may be inserted into or fitted into each of the second interlocking holes 82 provided in the front surface and the rear surface of the control box 80'. In an example, the second interlocking protrusion 9322*b* may be provided to be elastic and lose shape (e.g., deformed) while being inserted into the second interlocking hole 82 of the control box 80'. For example, in an example, when the second interlocking protrusion 9322*b* is inserted into or fitted into the second interlocking hole 82, the second interlocking protrusion 9322*b* may come into contact with the inner surface of the second interlocking hole 82 to lose shape (e.g., deformed) as it moves towards the second elastic portion 9324*b*, and may be continuously inserted until it passes through the second interlocking hole 82, after which point, the second interlocking protrusion 9322*b* may be restored to its original form to be caught and fixed to the second interlocking hole 82. Accordingly, it is possible to prevent the second interlocking protrusion 9322*b* from being separated from the second interlocking hole 82.

As described above, each of the front surface and the rear surface of the control box 80' may be connected to each of the opposing extension portions 16 of the housing 10', by means of the link structure 90*d*. According to an example, the first rotation axis R1' may be defined by the link structures 90*d* disposed on both sides of the front surface and the rear surface of the control box 80', and as described above, the control box 80' may rotate about the first rotation axis R1'. Further, as described above, according to an embodiment, the control box 80' may be moved between a position which overlaps more with the piping connection 33 and another position which overlaps less with the piping connection 33 and exposing at least part of the piping connection 33 downwardly, by means of the rotation about the first rotation axis R1'.

Figure 15:
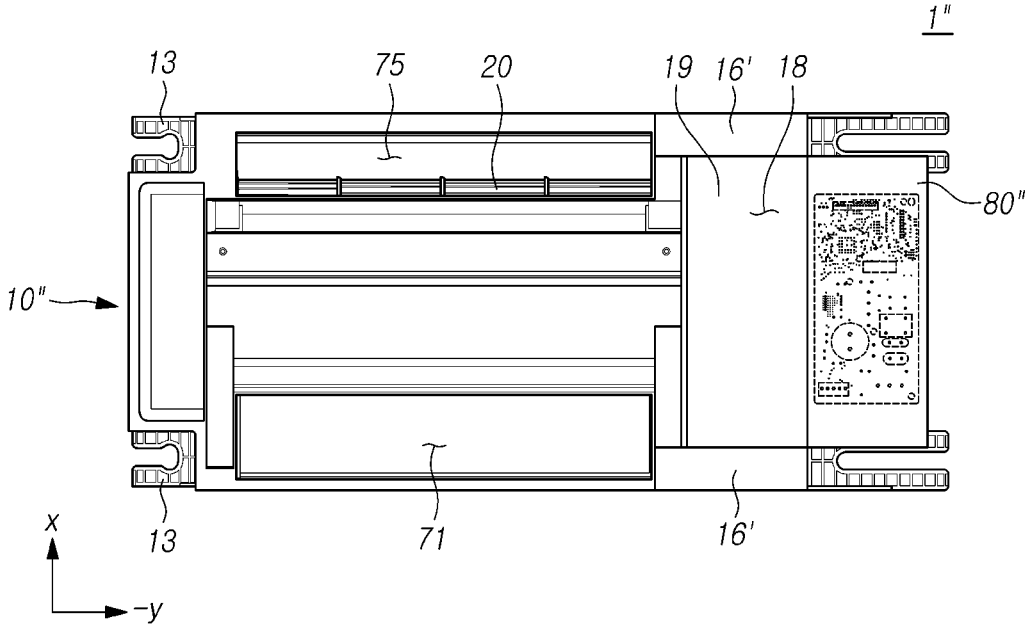
FIG. 15 is a view illustrating an air conditioner according to an embodiment of the disclosure installed on a ceiling with its ceiling panel removed, viewed from a bottom side.
Figure 16:
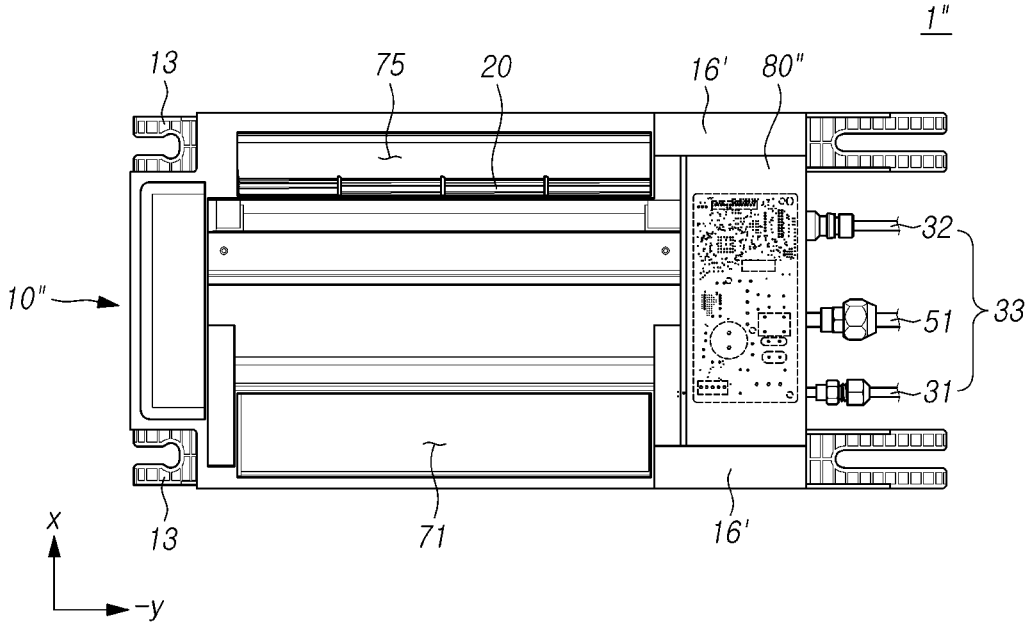
FIG. 16 is a view illustrating a control box disposed in a way for piping connection to be exposed in the air conditioner shown in FIG. 15 according to an embodiment of the disclosure.

FIG. 15 is a view illustrating an air conditioner, according to an example, installed on a ceiling with a ceiling panel removed, viewed from a bottom side. FIG. 16 is a view illustrating a control box disposed with a piping connection exposed in the air conditioner shown in FIG. 15. And FIG. 17 is a view illustrating a control box of the air conditioner shown in FIG. 16 separated from a housing.

In the case of the air conditioner (1 or 1') according to the embodiments described above with reference to FIGS. 3 to 11 or FIGS. 12 to 14, the control box (80 or 80') rotates along a rotational axis, and therefore, it is arranged at a position overlapping the piping connection 33 or arranged at a position to avoid, either completely or partially, from overlapping/covering the piping connection 33. On the other hand, in the case of the air conditioner 1", according to the embodiments described above with reference to FIGS. 15 to 17, the control box 80" moves along the guide rail formed in the housing 10" and may be disposed at a position to overlap with the piping connection 33 or to not overlap with the piping connection 33.

Figure 17:
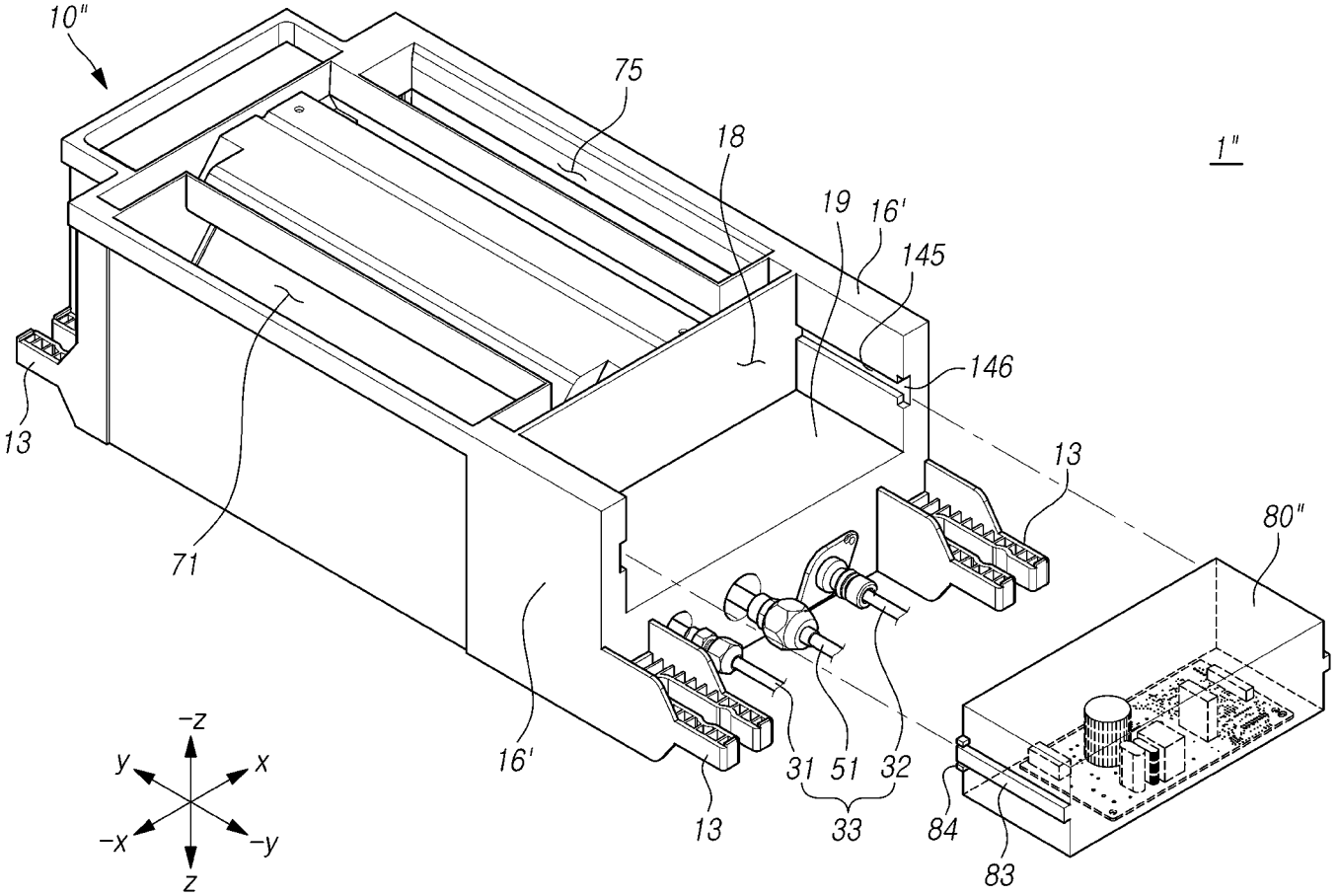
FIG. 17 is a view illustrating a control box of the air conditioner shown in FIG. 16 removed from a housing according to an embodiment of the disclosure.

Referring to FIGS. 15 to 17, the air conditioner 1" includes a housing 10". As illustrated, in an example, the housing 10" may include an extension portion 16' in which a front plate making up the front surface of the housing 10' and the rear plate making up the rear surface of the housing 10' extend to the right side, in the right-side portion where the intake port 71 and the discharge port 75 are arranged. Between the respective extension portions 16' of each of the front and rear sides, the housing 10" may have a recess portion 18 recessed concavely in the Z-axis direction. As illustrated in FIG. 16, the recess portion 18 may have a bottom surface 19.

At least part of the control box 80" may be disposed in the recess portion 18 above the bottom surface 19. Similar to the control box (80 or 80') described above, the control box 80" may have a rectangular parallelepiped shape (or cuboidal) and may include a PBA therein. As illustrated in FIGS. 15 to 17, the PBA substrate of the control box 80" of the air conditioner 1" may be disposed to face down the lower surface of the housing 10" on the XY plane.

Referring to FIG. 17, a sliding rail 145 may be disposed on each of the front- and rear-sided extension portions 16' of the housing 10" surrounding the recess portion 18. According to an example, a first stopper 146 may be disposed at the right end of the sliding rail 145. In an example, a sliding bar 83 may be disposed on each of the front surface and the rear surface of the control box 80". In an example, a second stopper 84 may be disposed at the left end of the sliding bar 83. In an example, the sliding rail 145 disposed on each of the front- and rear-sided extension portions 16' of the housing 10" may be coupled to the sliding bar 83 disposed on each of the front and rear surfaces of the control box 80". In an example, the sliding bar 83 of the control box 80" may be fitted into the sliding rail 145 and may move along the sliding rail 145 in the Y-axis direction. In an example, when the control box 80" moves to the right to be disposed to lie over (or overlap) the piping connection 33 vertically, the first stopper 146 disposed at the right end of the sliding rail 145 and the second stopper 84 disposed at the left end of the sliding bar 83 may be disposed to catch and stop each other. In an example, the control box 80" may be disposed in place (correct or intended position) without being completely separated from the housing 10", by locking between stoppers 146 and 84. In an example, the locking between the stoppers 146 and 84 may be configured not only to prevent the control box 80" from being separated from the housing 10" but also to prevent the control box 80", which reached a position overlapping the piping connection 33 vertically, from easily returning to its previous position, thereby assisting in maintaining its correct position of the control box 80".

What is claimed is:

1. An air conditioner that is installable in a ceiling, the air conditioner comprising:

a housing having an intake port;

a piping connection including one or more pipes connected from an inside of the housing to an outside of the housing;

a blower fan inside the housing; and a control box configured to control driving of the blower fan, wherein the control box is connected to opposite sides of the housing so as to be movable, when the air conditioner is installed in the ceiling, between a first position in which the control box overlaps the piping connection vertically, and a second position in which the control box overlaps less of the piping connection than when the control box is in the first position, while maintaining connection to the housing.

2. The air conditioner according to claim 1, wherein the control box is closer to the intake port in the second position than in the first position.

3. The air conditioner according to claim 1, further comprising a link assembly including a first connector defining a first rotation axis and connected to the housing, and the control box is movable between the first position and the second position by rotation of the link assembly about the first rotation axis.

4. The air conditioner according to claim 3, wherein the link assembly includes:

a second connector defining a second rotation axis parallel to the first rotation axis, and connected to the control box, and the control box is rotatable about the second rotation axis.

5. The air conditioner according to claim 4, wherein the housing includes a first interlocking hole, the control box includes a second interlocking hole, the first connector of the link assembly includes:

an annular first protrusion inserted into the first interlocking hole in the housing, and the second connector of the link assembly includes:

an annular second protrusion inserted into the second interlocking hole in the control box.

6. The air conditioner according to claim 5, wherein the annular first protrusion and the annular second protrusion are each configured to have a tapered shape with a diameter that gradually decreases toward an outside of the link assembly.

7. The air conditioner according to claim 4, wherein the link assembly includes a first link structure and a second link structure, wherein the first link structure connects a first side of the control box to a first side of the housing, and the second link structure connects a second side of the control box to a second side of the housing.

8. The air conditioner according to claim 4, wherein the link assembly includes a link body integrally connecting the first connector and the second connector.

9. The air conditioner according to claim 3, further comprising:

an electric wire electrically connecting the blower fan and the control box, wherein the link assembly includes:

a link body having a wire receiving space formed to receive the electric wire.

10. The air conditioner according to claim 9, wherein the link assembly includes:

a link cover detachably coupled to the link body to cover the wire receiving space.

11. The air conditioner according to claim 10, wherein a coupling groove is formed in the link body, and the link cover includes:

a coupling protrusion that is insertable into the coupling groove to attach the link cover to the link body.

12. The air conditioner according to claim 4, further comprising:

an electric wire electrically connecting the blower fan and the control box, wherein the link assembly includes:

a link body having a wire receiving space formed to receive the electric wire, the first connector includes a first wire hole communicating with the wire receiving space, the second connector includes a second wire hole communicating with the wire receiving space, the first wire hole opens into the link body in a direction parallel to the first rotation axis, the second wire hole is spaced apart from the first wire hole in a horizontal direction and opens into the link body in a direction parallel to the second rotation axis, and the electric wire passes through the first wire hole, the wire receiving space, and the second wire hole.

13. The air conditioner according to claim 8, wherein the link body includes:

a first slit formed on a first end of the link body so as to extend along an axial direction of the first rotation axis, and a second slit formed on a second end of the link body so as to extend along an axial direction of the second rotation axis.

14. The air conditioner according to claim 1, further comprising:

a stopper protruding from one side surface of the housing to fix the control box in the first position.

15. The air conditioner according to claim 14, wherein the stopper is adjacent to a lower end of the one side surface of the housing.

* * * * *